US006331701B1

(12) United States Patent
Chen et al.

(10) Patent No.: US 6,331,701 B1
(45) Date of Patent: Dec. 18, 2001

(54) RF-GROUNDED SUB-DEBYE NEUTRALIZER GRID

(76) Inventors: Lee Chen, 1121 Strickland Dr., Austin, TX (US) 78748; Chen Yvonne, 12805 Decoy Cove, Austin, TX (US) 78729

( * ) Notice: Subject to any disclaimer, the term of this patent is extended or adjusted under 35 U.S.C. 154(b) by 0 days.

(21) Appl. No.: 09/315,456

(22) Filed: May 20, 1999

Related U.S. Application Data

(60) Provisional application No. 60/086,091, filed on May 20, 1998.

(51) Int. Cl.[7] ..... H05H 3/02
(52) U.S. Cl. ..... 250/251; 315/111.81
(58) Field of Search ..... 250/251; 315/111.81

(56) References Cited

U.S. PATENT DOCUMENTS 4,612,477 * 9/1986 Dothan ..... 315/111.81
4,684,848 * 8/1987 Kaufman et al. ..... 315/111.81
5,468,955 * 11/1995 Chen et al. ..... 250/251
5,883,470 * 3/1999 Hatakeyama et al. ..... 250/251

* cited by examiner

*Primary Examiner*—Jack Berman
(74) *Attorney, Agent, or Firm*—Booth & Wright, L.L.P.; Matthew J. Booth

(57) ABSTRACT

The present invention discloses an RF-grounded sub-Debye neutralizer grid that is suitable for use in a plasma reactor and with a plasma beam. The grid comprises a grid core that is RF-grounded. The grid core comprises a plurality of grid holes. Each individual grid hole of the plurality of grid holes further comprises a sub-Debye hole where the diameter of said sub-Debye hole is smaller than the sheath thickness of the plasma and where the sub-Debye hole has a high aspect ratio. Additionally, an inner surface of each individual grid hole of the plurality of grid holes forms a natural ceramic in the presence of the plasma where the inner surface produces a surface neutralization by shallow angle elastic surface forward scattering.

16 Claims, 17 Drawing Sheets

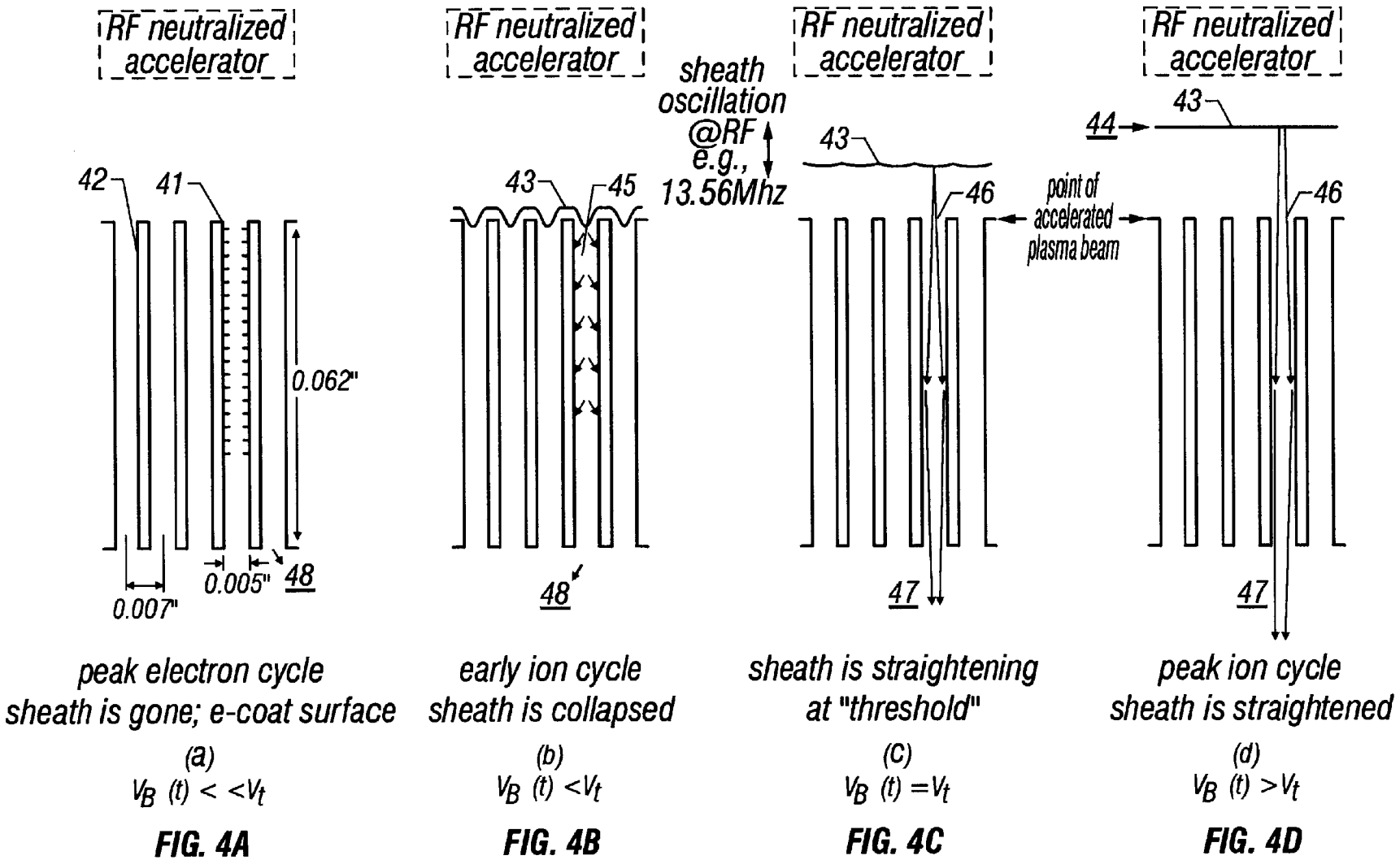
RF neutralized accelerator
42
41
0.062"
0.005"
48
0.007"
peak electron cycle
sheath is gone; e-coat surface
(a)
$V_B(t) << V_t$
FIG. 4A
RF neutralized accelerator
43
45
48
early ion cycle
sheath is collapsed
(b)
$V_B(t) < V_t$
FIG. 4B
sheath oscillation @RF e.g., 13.56Mhz
RF neutralized accelerator
43
46
47
sheath is straightening at "threshold"
(c)
$V_B(t) = V_t$
FIG. 4C
RF neutralized accelerator
44
43
46
point of accelerated plasma beam
47
peak ion cycle
sheath is straightened
(d)
$V_B(t) > V_t$
FIG. 4D

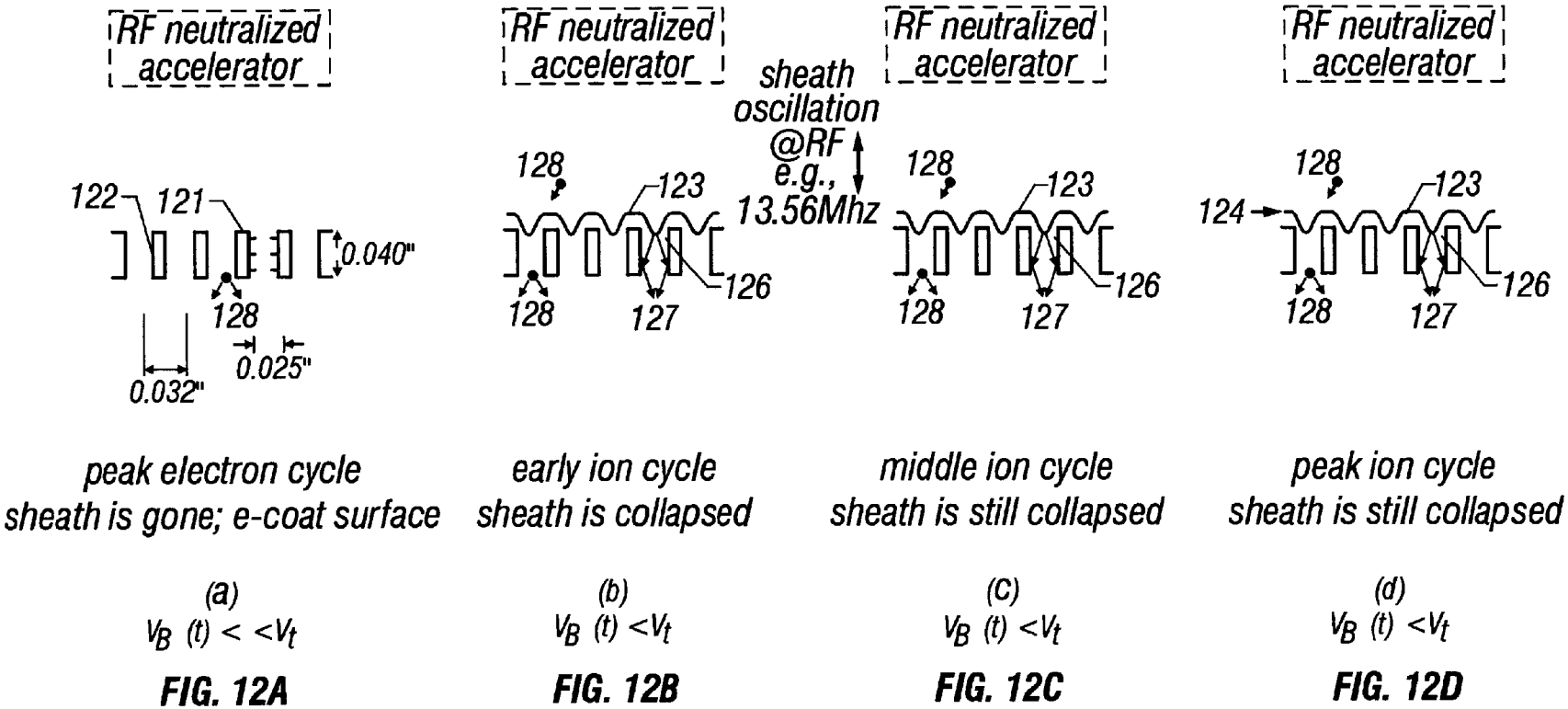
RF neutralized accelerator
122
121
128
0.032"
0.025"
0.040"
peak electron cycle
sheath is gone; e-coat surface
(a)
$V_B(t) << V_t$
FIG. 12A
RF neutralized accelerator
123
126
127
128
early ion cycle
sheath is collapsed
(b)
$V_B(t) < V_t$
FIG. 12B
sheath oscillation @RF e.g., 13.56Mhz
RF neutralized accelerator
123
126
127
128
middle ion cycle
sheath is still collapsed
(c)
$V_B(t) < V_t$
FIG. 12C
RF neutralized accelerator
123
124
126
127
128
peak ion cycle
sheath is still collapsed
(d)
$V_B(t) < V_t$
FIG. 12D

RF-GROUNDED SUB-DEBYE NEUTRALIZER GRID

This application claims the benefit of the earlier filed U.S. Provisional Application Ser. No. 60/086,091, filed May 20, 1998, which is incorporated by referenced for all purposes into this application.

BACKGROUND OF THE INVENTION

Field of the Invention

The present invention relates to a "source" (the hardware) that generates the Hyperthermal Neutral Beam. A hyperthermal neutral beam is a beam of translationally energetic neutrals. They can be controlled generally in the energy range of 20 eV<$E_K$<400 eV while their thermal spread is in the range of 0.1 eV to 2 eV. The "Hyperthermal Neutral Beam Source" comprises several critical and innovated components. A specific example of this source is the Hyperthermal O-beam Source which generates a beam of hyperthermal atomic oxygen. The Hyperthermal O-beam has many important applications in advanced wafer fabrication processes. In the Lithography area, a Directional Hyperthermal O-beam can be used for anisotropic dry development (bi-layer resist scheme as well as Top Surface Imaging in the DUV and EUV exposure range). In the Interconnect area, a Directional Hyperthermal O-beam can be used for anisotropic etching of polymeric low-κ inter-level dielectric. In the Ion-Implant and Interconnect areas, a Divergent Hyperthermal O-beam can be used for stripping heavily cross-linked polymer. Therefore, the Hyperthermal O-beam Source will be used as an example to elaborate this invention.

High Density Plasma RIE (Reactive Ion Etching)

The present invention comprises an anisotropic polymer etching method for both Dry Development (Lithography) and low-κ polymeric dielectric etching (Interconnect). The $O_2$-based high density plasma RIE is basically an ion-assisted plasma etching. This anisotropic etching method has the following undesired issues:

1. Wafer cooling to low temperature, sometimes as low as −100° C., is needed for anisotropy.
2. Gas mixture such as $SO_2$+$O_2$ is needed for side-wall passivation in order to achieve anisotropy; $SO_2$ also has many undesired effects in wafer processing.
3. Its etching mechanism requires initial chemisorption of thermalized O and $O_2$* and followed by directional ion bombardment. The requirement of initial chemisorption makes the etching process strongly dependent on the type of polymer (type of photoresist, polymer film, low-κ polymer) being etched.
4. The etching process parameter window when existed, is very small and unstable.
5. Strong chemical loading effect ("macro-loading" or, pattern-factor loading).
6. Strong "micro-loading" effect (feature-dependent loading or, aspect ratio dependent loading). Under the feature-dependent loading effect, isolated features etch differently than dense features both in terms of etch rate and anisotropy. From the same loading mechanism, high aspect ratio features etch differently than low aspect ratio features both in terms of etch rate and anisotropy.
7. Charging effects on the features. In order to avoid the charging effects, strict restrictions are generally inflicted on the process parameters.

Down-Stream Plasma Etching/Ashing

The present invention also comprises an $O_2$ based (sometimes with gas mixture) down-stream plasma method for stripping resist after plasma etching steps and after ion implant steps. It is sometimes used for cleaning of organic contaminants. This isotropic etching/ashing method utilizes primarily thermalized O and O*. As a result, the wafer would have to be at high temperature (as high as 250° C.) in order for the Arrhenius reaction to take place. Aside from some stringent organic contaminant cleaning steps, this high temperature environment is fine for wafers with ordinary polymer layers. However, some etching and ion implant steps heavily cross-link the polymer. Heavily cross-linked polymer cannot be etched by this method, not even at high temperature. The removal of such heavily cross-linked resist falls on the undesired liquid acid bath.

Hyperthermal O-beam

A Hyperthermal O-beam is a beam of translationally energetic O and its energy is generally controllable in the range of 20 eV<$E_K$<400 eV with thermal spread in the range of 0.1 eV to no more than 2 eV. The Hyperthermal O-beam polymer etching mechanism resembles a chemical sputtering one. It is depicted by FIG. 13. The translationally hot O impinges the polymer surface penetrating the very top atomic layer and thermalizing with the polymer through bond-breaking collisions until a volatile product such as CO or $H_2O$ is formed. Then, the etching is done. This chemical sputtering like etching mechanism does not distinguish the polymer type since the up-taking of the O by the polymer is pre-determined by the polymer bond-breaking collisions and it does not depend on the chemisorption of the thermal O by the polymer. Also, this etching mechanism is unlike that of down-stream plasma etching nor that of biased high density plasma etching which both require initial chemisorption of O onto the polymer surface followed by the etch product bond-forming excitation to proceed etching. The requirement of chemisorption of O by the polymer (as in the plasma cases) depends strongly on the polymer type and making the etching polymer type dependent. In FIG. 13, a Directional Hyperthermal O-beam (e.g., small divergent angle, $\theta_0$~6° to 3°) has more than sufficient normal energy to make down to the bottom of a high aspect ratio feature through surface forward scattering off the feature's vertical surface, while still retaining a vast majority of its initial $E_K$ (kinetic energy). Therefore, a large open area etches the same as a region of dense features; i.e., there is no feature-dependent (sometimes called aspect ratio dependent) loading effect.

Also shown in FIG. 13, the incident Hyperthermal O penetrates the top layer and thermalizes with the bulk through bond-breaking collisions with the polymer. The gradient of the equal-$E_K$ lines indicates the thermalization. In the microscopically-rough sub-surface, when the scattering Hyperthermal O is sufficiently thermalized, the etch product bond can then be formed (e.g., $H_2O$, CO, $SO_2$, etc.) and etching is done. In ion-assisted plasma etching of polymer, the chemisorption of thermal O from the plasma is a necessary step. The thermal O dosage to the polymer surface in Hyperthermal O-beam etching is many orders of magnitude less than that in the plasma cases. Unlike plasma-based etching, the up-taking of the O in the Hyperthermal O-beam etching is predetermined by the bond-breaking collisions. Roughly, one incident Hyperthermal O is responsible in removing one surface atom, in the form of the etch product. Therefore, Hyperthermal O-beam etching does not distinguish the type of polymer nor the wafer surface temperature and the etching does not exhibit any chemical loading (sometimes called pattern-factor loading) effect.

This invention is the only known method to generate a beam (directional or divergent) of high flux and translationally energetic atomic oxygen with the beam diameter from less than 1" to greater than 10". For the 1" Directional Hyperthermal O-beam Source, the Hyperthermal O flux as high as 15 $mAcm^{-2}$ (current-equivalent) and polymer etch rate as high as 1 $\mu$m/min have been obtained. FIG. 14 shows its polymer etch rate vs. Hyperthermal O energy. The increase in etch rate corresponds to an increase in the Hyperthermal O flux due to the increasing beam energy. For the case of 10" diameter Directional Hyperthermal O-beam, the first generation prototype can reach a Hyperthermal O flux as high as 6 $mAcm^{-2}$ (current-equivalent) and polymer etch rate as high as 4500 Å/min. FIG. 15 shows its polymer etch rate and etch uniformity vs. total input RF power to the 10" source. Minor alteration to the accelerator and the neutralizer grid of the 10" prototype source can double the etch rate and half the etch non-uniformity, as will be described in the body of the invention. FIG. 16 shows the SEM cross section of the etched dense lines. FIG. 16(*a*) is $SiO_2$ masked polymer features and FIG. 16(*b*) is the etched bi-layer features. FIG. 17 shows the SEM cross section of the dense lines FIG. 17(*a*) and the adjacent isolated line FIG. 17(*b*). There is no feature-dependent (sometimes called aspect ratio dependent) loading effect. There is no pattern-factor loading; via patterned wafer etch at the same rate as blanket wafer. Another SEM example is shown in FIG. 17 for bi-layer dry development. The figure is the initial image pattern as defined by Lithography which is 10%-Si photosensitive resist. The figure shows the etched (dry developed) plasma-resistant polymer by using the initial image pattern.

SUMMARY OF THE INVENTION

The present invention starts with a low pressure high density plasma ($1\times10^{-4}$ torr<$P_0$<50 mtorr and primary plasma density is $n_e\sim1\times10^{11}$ $^{cm-3}$ to $1\times10^{13}$ $cm^{-3}$) in a liquid-submerged design for efficient cooling of the primary plasma at high power operation. In general, the primary plasma can be of any sort: ECR (electron cyclotron resonance), Helicon plasma (electron Landau damping), RF induction plasma. RF induction plasma is the simplest and it is adequate for the Hyperthermal Neutral Beam Source in application to surface modification. The special, RF dielectric constant trimmed RF coil (or antenna in Helicon case) designs are disclosed for the specific liquid-submerged design, for efficient RF induction.

A controlled portion of the input RF power is tapped off the induction coil through a coupling capacitor $C_C$ into the super-Debye accelerator, giving the accelerator its (controlled) potential $V_B(t)$. The plasma inside the beam source floats with the accelerator to an artificial plasma potential, $V_{PA}(t)\sim V_B(t)$. The magnitude and shape of $V_B(t)$ (and hence $V_{PA}(t)$) are controlled by the value of $C_C$ and the surface area ratio between the accelerator ($A_A$) and the neutralizer ($A_G$), specifically, $(A_A/A_G)^X$ where X is theoretically 4 and experimentally takes on the range of 2 to 4. The surface area for the accelerator is the accelerator surface related to the plasma by the natural plasma potential $V_P(t)$ and the surface area for the neutralizer is the neutralizer surface related to the plasma by the artificial plasma potential $V_{PA}(t)$. This artificial plasma potential ($V_{PA}(t)$) accelerates the plasma towards the RF-grounded sub-Debye neutralizer grid. A space-charge neutralized plasma beam of the desired energy ($E_K=V_{PA}(t)\sim V_B(t)$) is completed just before the plasma beam enters the holes of the RF-grounded sub-Debye neutralizer grid. This RF accelerator method can produce a space-charge neutralized plasma beam without any of the adverse effects due to the space-charge limitation. Generally, the DC accelerator can only produce an ion beam and it is space-charge limited. The RF accelerator is the only known method to generate a plasma beam without using a Lorentz force from a bulky external magnetic field.

A small diameter (e.g., ~1") Hyperthermal O-beam generally has a Gaussian intensity profile and the uniformity of the primary plasma and the plasma beam are not important. A flat intensity profile is desired for the large diameter (e.g., ~10") Hyperthermal O-beam for polymer etching. In this case, the primary plasma uniformity is still not critical. However, its plasma beam uniformity is critical. The plasma beam uniformity is controlled by the shape of the super-Debye accelerator, specifically, the super-Debye accelerator's spatial surface area density.

The RF-grounded sub-Debye neutralizer grid surface can be an insulator; it has a RF-grounded core. The RF accelerator method does not have a DC path anywhere in the system. For the example of Hyperthermal O-beam, the grid core can be Al and its surface is naturally $Al_2O_3$ in the presence of the pure $O_2$ plasma. The completed plasma beam pulses at the used RF frequency, for example, $\omega_1$=13.56 Mhz. With this example $\omega_1$, the electron cycle (negative cycle) generally lasts around ~5 ns. During which, electrons coat the grid surface. The immediate ion cycle (positive cycle) generally lasts around ~65 ns. During which, a constrainted amount of ions, exactly equal in number to the earlier electrons (due to the capacitively coupled RF accelerator method), are burst out. These ions of the completed plasma beam enter the grid holes. A vast majority of them graze the inner surface of the holes. The interaction is a surface neutralization by shallow angle elastic surface forward scattering. This particular surface neutralization action neutralizes the ions: $O^+ + e^-. + h/\lambda \rightarrow O^*$, for the Hyperthermal O-beam example where $h/\lambda$ is the phonon supplied by the grid surface, $O^*$ forms the initial Hyperthermal O-beam which propagates at the same energy as the completed plasma beam ($E_K\sim V_{PA}(t)\sim V_B(t)$) due to the surface elastic forward scattering process, and $O^*$'s finite lifetime leads to $O^* \rightarrow O + hf$. The photon emission (hf) of the Hyperthermal O-beam makes the propagation of the Hyperthermal O-beam visibly noticeable.

Due to the finite transparency of the RF-grounded sub-Debye neutralizer grid, proper engineering is necessary for an efficient cooling of the grid, especially for a large diameter (~10")beam.

The capacitively coupled RF accelerator does not have to tap the power off the RF coil (or antenna) via $C_C$. The $C_C$ tapping method is economical and convenient. An external bias can be applied. In the case of ECR (microwave frequency) primary plasma or, high plasma beam power operation or, DC ion beam extraction, the external bias method can be applied.

An RF-grounded sub-Debye neutralizer grid is crucial for the Directional Hyperthermal O-beam which can be applied for anisotropic polymer etching. For resist stripping and organic contaminant cleaning, a much simpler RF-grounded neutralizer grid can be used to produce a Divergent Hyperthermal O-beam. Such grid borders sub-Debye and super-Debye and it is much easier and cheaper to be fabricated.

BRIEF DESCRIPTION OF THE DRAWINGS

To further aid in understanding the invention, the attached drawings help illustrate specific features of the invention and the following is a brief description of the attached drawings:

FIG. 4 is a representative drawing showing the side view cross section of a section of the RF-grounded sub-Debye neutralizer grid (for the Directional Hyperthermal Neutral Beam) and its operation during one RF period.

FIG. 12 is a representative drawing showing the side view cross section of a section of the RF-grounded, border-line sub-Debye neutralizer grid (for Divergent Hyperthermal Neutral Beam) and its operation during one RF period.

DESCRIPTION OF THE PREFERRED EMBODIMENTS

The present invention comprises an RF-grounded sub-Debye neutralizer grid that is suitable for use in a plasma reactor and with a plasma beam. This disclosure describes numerous specific details that include plasma reactors, plasma generators, plasma beams, wafer etching, and wafer cleaning. One skilled in the art will appreciate that one may practice the present invention without these specific details.

Figure 1:
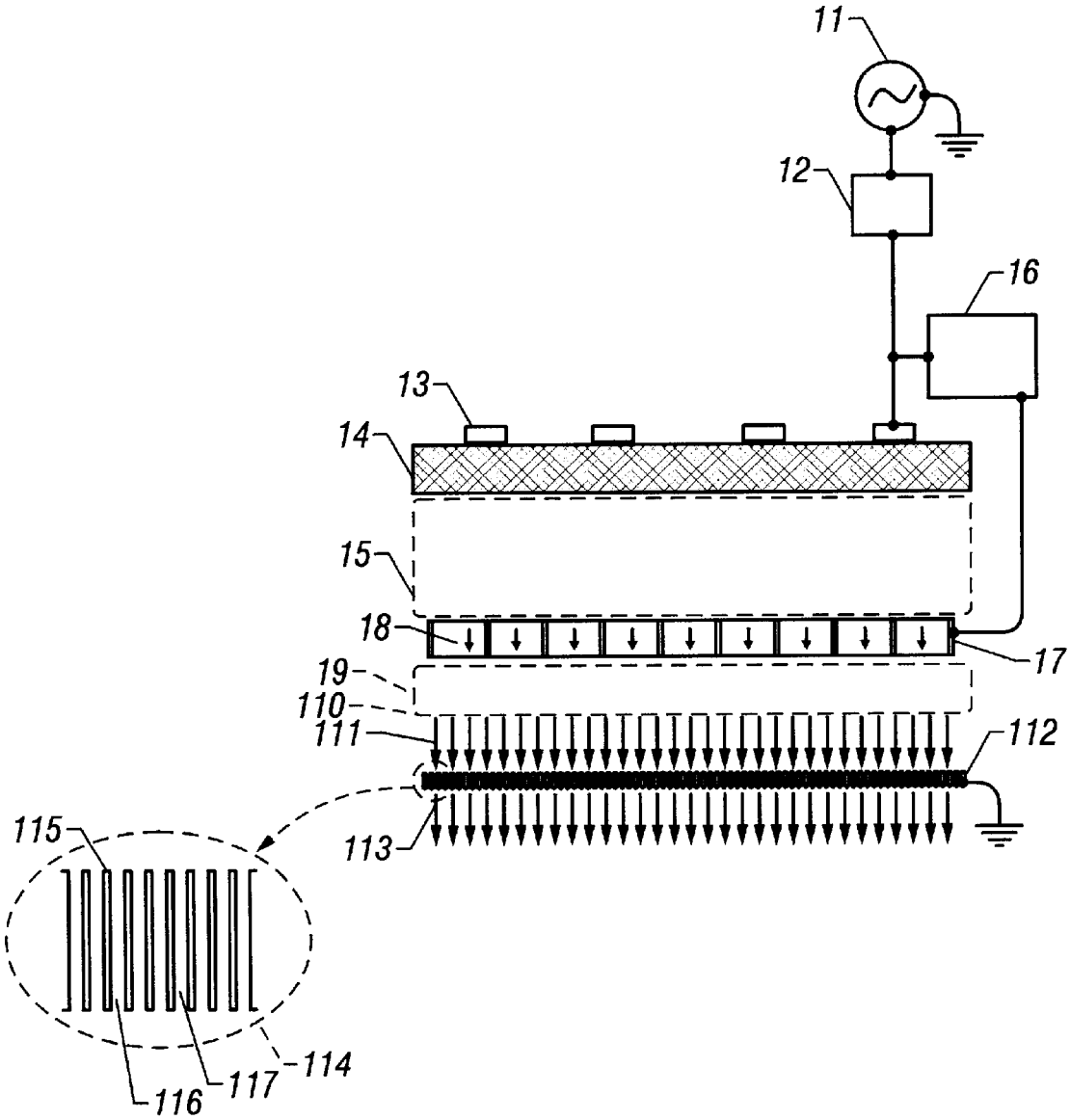
FIG. 1 is a representative side view cross section showing all the critical components to the Hyperthermal Neutral Beam Source. This drawing is especially representative to a large diameter (e.g., ~10") Hyperthermal O-beam.
Figure 6:
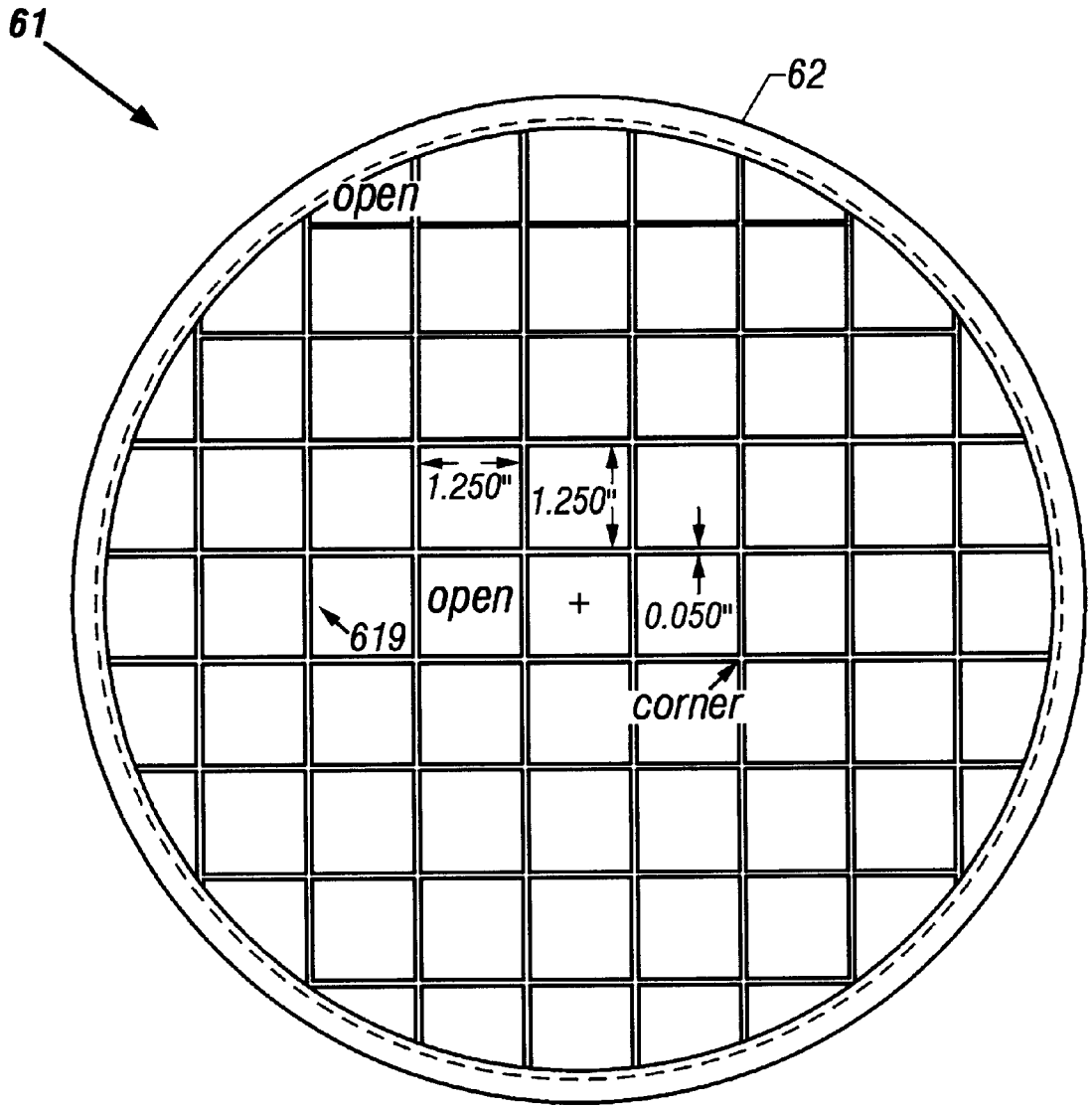
FIG. 6 is a schematic diagram showing the top view of an example of the capacitively coupled RF accelerator for the 10" diameter Directional Hyperthermal O-beam Source.

The first principle diagram for this invention is FIG. 1. The RF generator 11 can be 13.56 Mhz as an example. Reference 12 is an appropriate arrangement of variable $C_P$ (parallel capacitor) and $C_S$ (series capacitor) for impedance matching for the specific liquid-submerged plasma. Reference 13 is the RF inductor. Reference 14 is the RF window (e.g., quartz or ceramic). Reference 15 is the primary plasma. The uniformity of the primary plasma is not important. Therefore, the RF coil can be any convenient shape. For example, a two-turn flat coil. Reference 17 is the RF accelerator (note, FIG. 6 shows the top view of the RF accelerator, as an example). Reference 16 is the capacitively coupled RF accelerator circuit that taps RF power off the RF coil. Reference 16 supplies the RF power to the RF accelerator to the potential $V_B(t)$. The primary plasma diffuses through the super-Debye RF accelerator as shown by the arrows through reference 18. Also, reference 18 denotes the "surface" of the RF accelerator which is $A_A$. This surface relates to the plasma by the natural plasma potential $V_P(t)$. The diffusion leads to reference 19 which is a quiescent plasma at the artificial plasma potential $V_{PA}(t)$. Reference 110 is the sheath boundary of the quiescent plasma, from which, the plasma starts its acceleration. Reference 111 is the plasma beam. Just before reaching the top surface of the RF-grounded sub-Debye Debye neutralizer grid (denoted $A_G$, 115), the plasma beam 111 becomes fully accelerated becoming the completed plasma beam. The surface $A_G$ of 115 relates to the plasma by the artificial plasma potential $V_{PA}(t)$. Reference 112 is the RF-grounded sub-Debye neutralizer grid. Reference 114 shows a blow-up of a section of this grid. Reference 117 is the high aspect ratio hole of this grid. Reference 116 is the inner surface of the hole of this grid. After the point of 115, the plasma beam is completed ($E_K=V_{PA}(t)\sim V_B(t)$) and there is no more meaningful acceleration. On the surface of 116, the ions (e.g., $O^+$) undergo surface neutralization by shallow angle elastic surface forward scattering, becoming the Hyperthermal neutrals (e.g., $O^*$, immediately after surface neutralization). Reference 113 is the Hyperthermal Neutral Beam (e.g., O-beam).

Figure 15:
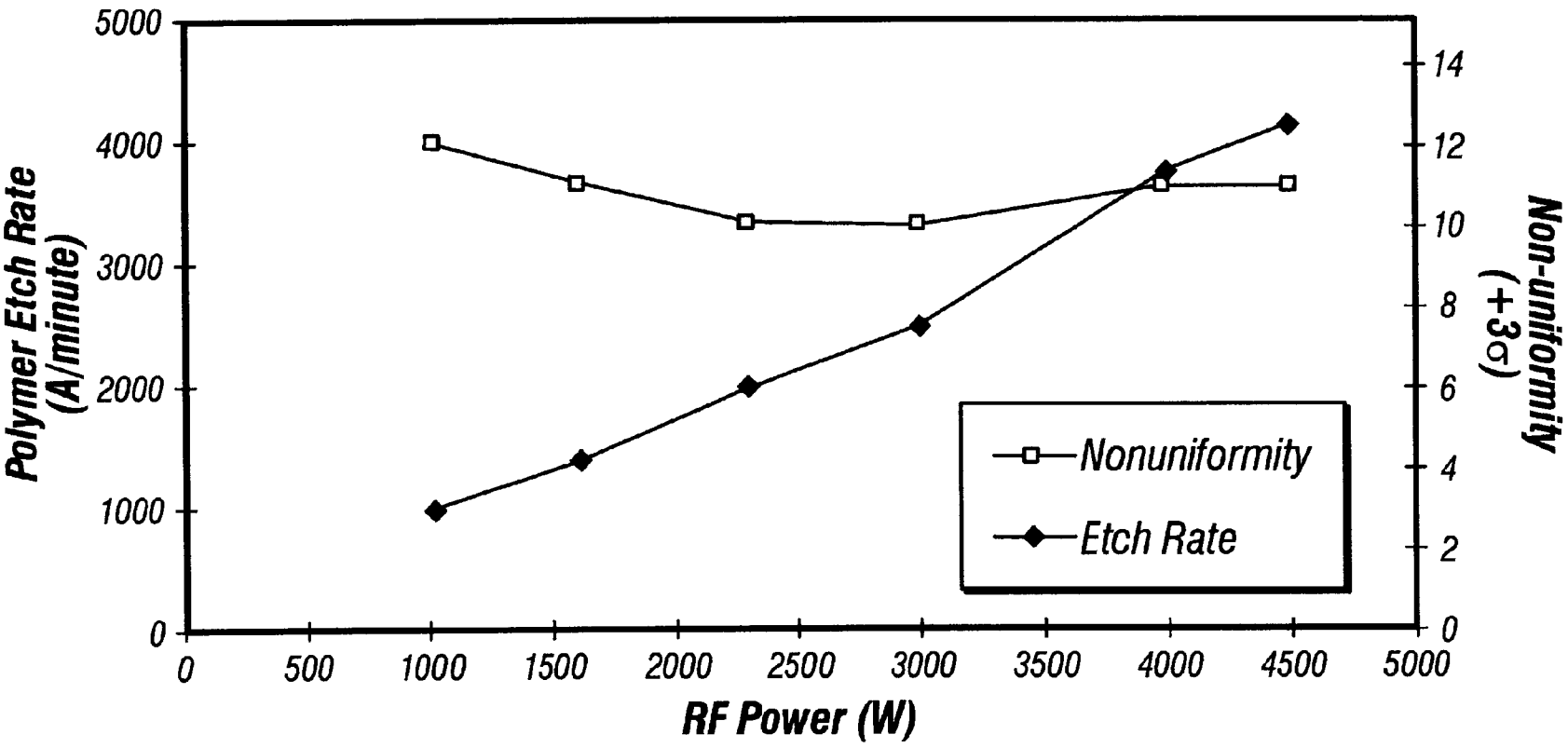
FIG. 15 shows the data of polymer etch rate and etch uniformity as a function of the total RF power to the 10" diameter Directional Hyperthermal O-beam Source.
Figure 16A:
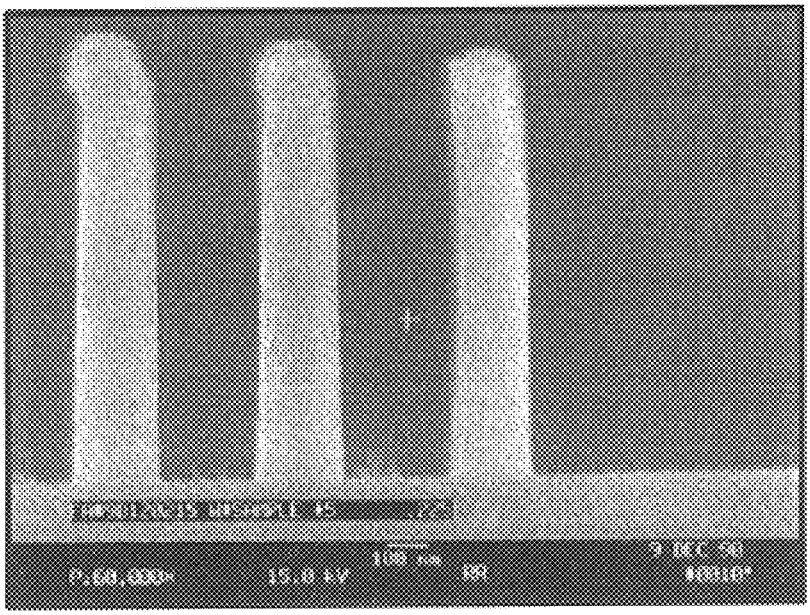
FIG. 16 shows the SEM (scanning electron microscope) cross section images of etched wafers.
Figure 16B:
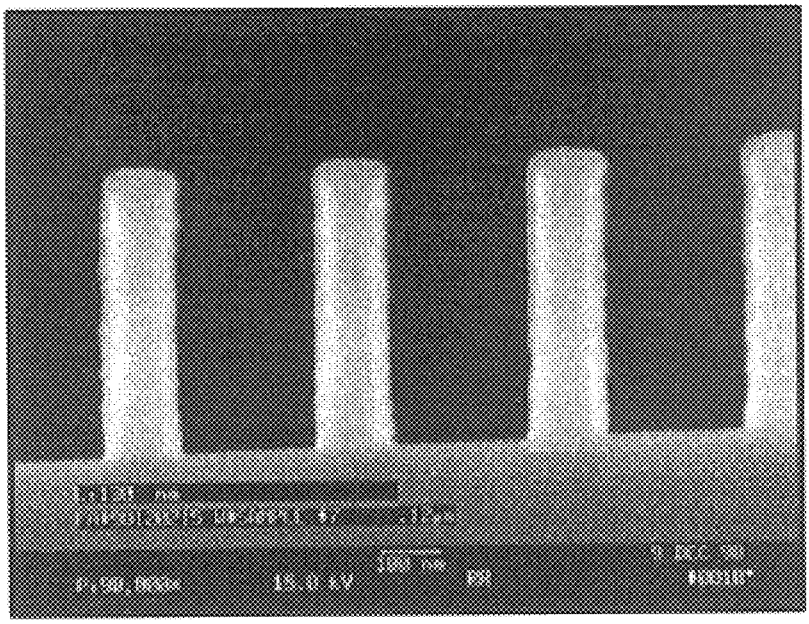
Figure 17A:
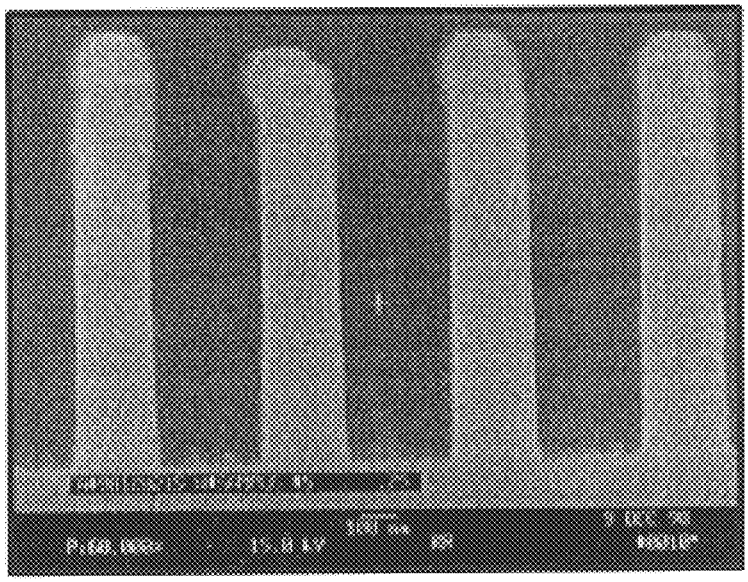
FIG. 17 shows the SEM cross section images of dense features and the adjacent isolated feature.
Figure 17B:
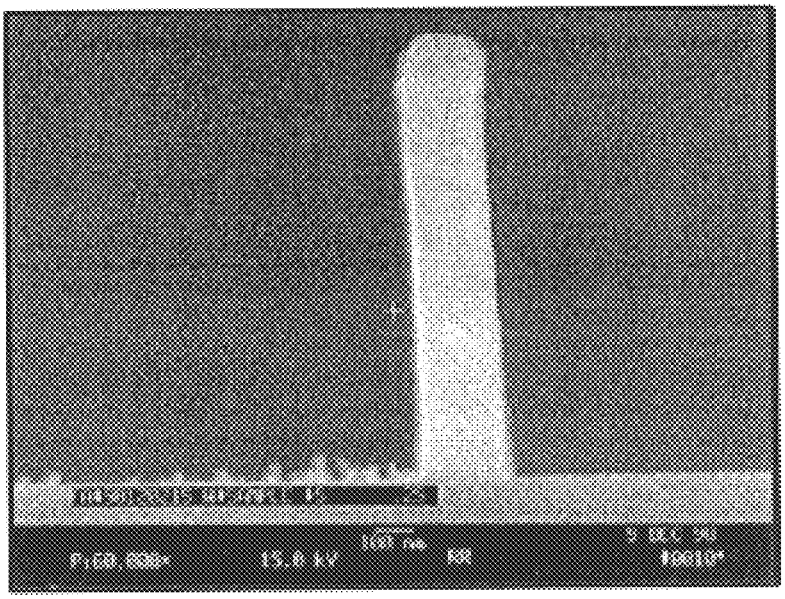
Figure 18A:
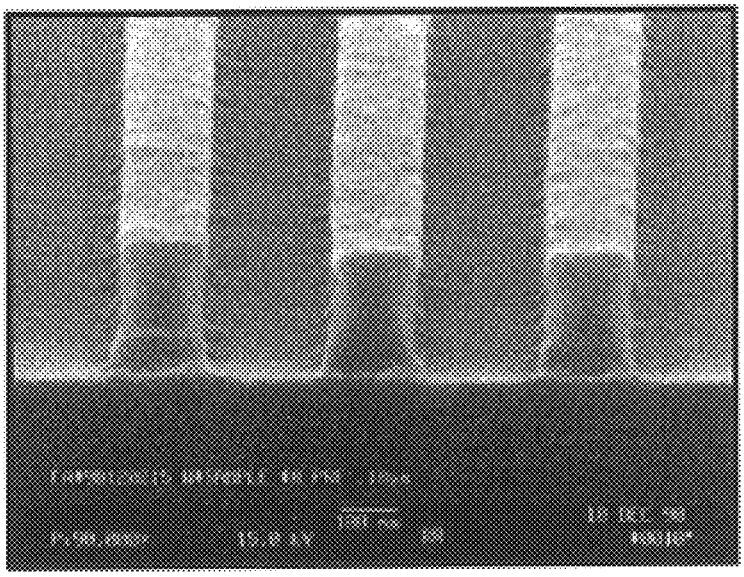
FIG. 18 shows the before and after etch SEM cross section images for the bi-layer Lithography.
Figure 18B:
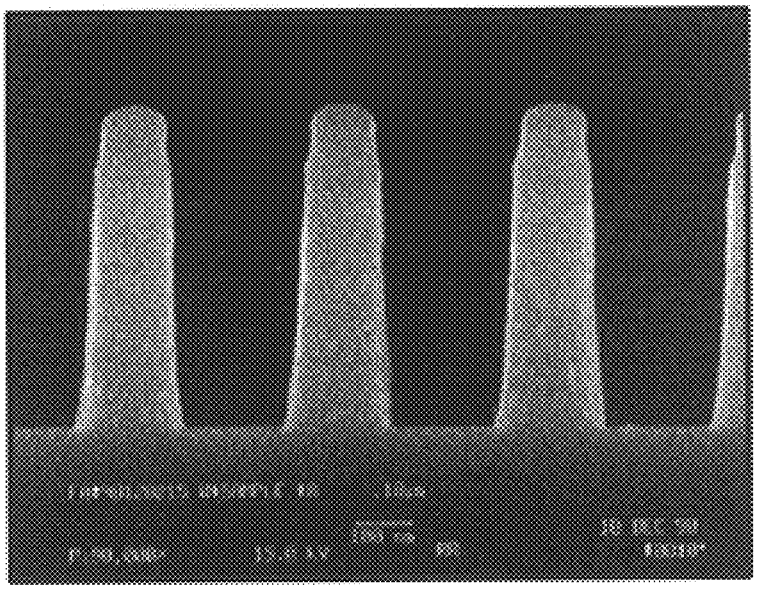

The main component inside reference 16 is the coupling capacitor $C_C$. The uniformity of the Hyperthermal neutral beam is determined by the uniformity of the accelerated plasma beam which is largely determined by the uniformity of reference 19, the quiescent plasma. Reference 18, the surface of the RF accelerator ($A_A$) has the effect of a "plasma terminator". As the primary plasma diffuses through 17, the RF accelerator, $A_A$ acts like a homogenizer making a uniform $V_{PA}(t)$. The density uniformity of the quiescent plasma is determined by the spatial surface area density of the RF accelerator. Therefore, by slight tailoring of the height of reference 17, a uniform density quiescent plasma can be achieved. For example, the first-pass prototype with n uniform height RF accelerator (17) can produce an azimuthally uniform quiescent plasma (19) with only radial non-uniformity. The radial non-uniformity is center intensity being ~10% higher than the edge intensity, as shown in FIG. 15. Although $3\sigma\sim\pm10\%$ is adequate for Hyperthermal O-beam polymer etching processes, the radial $3\sigma$ can be dropped below ±5% by simply inducing a 10% linear height gradient on the RF accelerator from center to edge with the center having a higher surface area.

Figure 10:
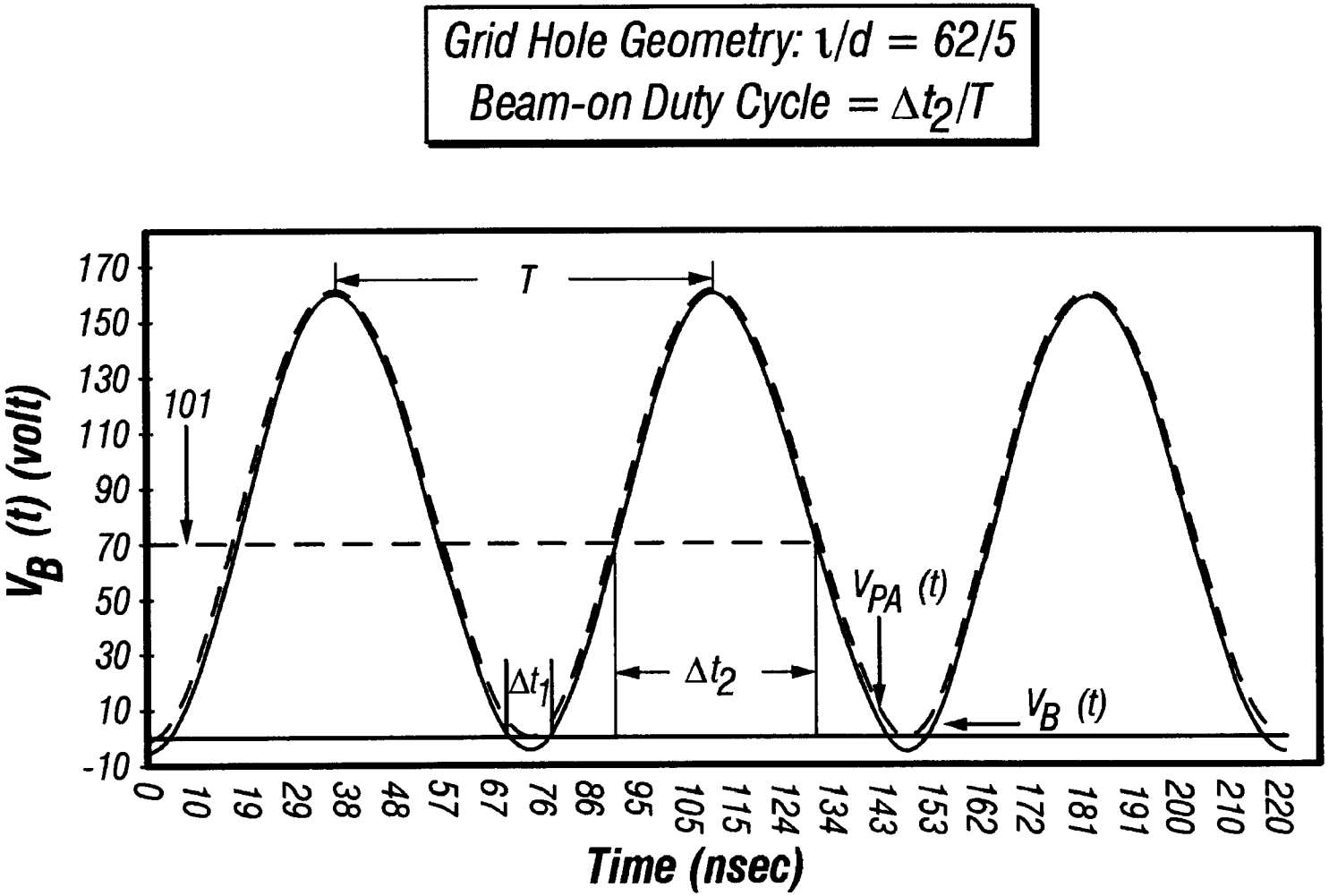
FIG. 10 is a diagram showing the time function of $V_B(t)$ (the potential on the RF accelerator), $V_{PA}(t)$ (the artificial plasma potential) and the beam-on duty cycle of the emerging Hyperthermal Neutral Beam.

The magnitude and the shape of $V_{PA}(t)\sim V_B(t)$ are depicted in FIG. 10. The magnitude is the value between the peaks, $|V_{B+peak}|+|V_{B-peak}|$. The shape is the positive offset. The positive offset can be quantified by the peaks' ratio and it is $|V_{B+peak}|/|V_{B-peak}|=(A_A/A_G)^X$. $A_A$ is the RF accelerator area (largely contributed by 18), $A_G$ is the related neutralizer area shown by reference 115 (not reference 116), X is theoretically 4 and experimentally 2 to 4. It is desired to have an offset as shown by the example in FIG. 10. Therefore, appropriate area ratio is needed. Also, for the example of Hyperthermal O-beam production, the primary plasma metal boundary (i.e., all the RF accelerator surface and any metal in electrical contact with it) should be anodized. Generally, Al can be used as the metal. The anodized surface is a stable $Al_2O_3$ which provides homogeneity and plasma stability.

Figure 2:
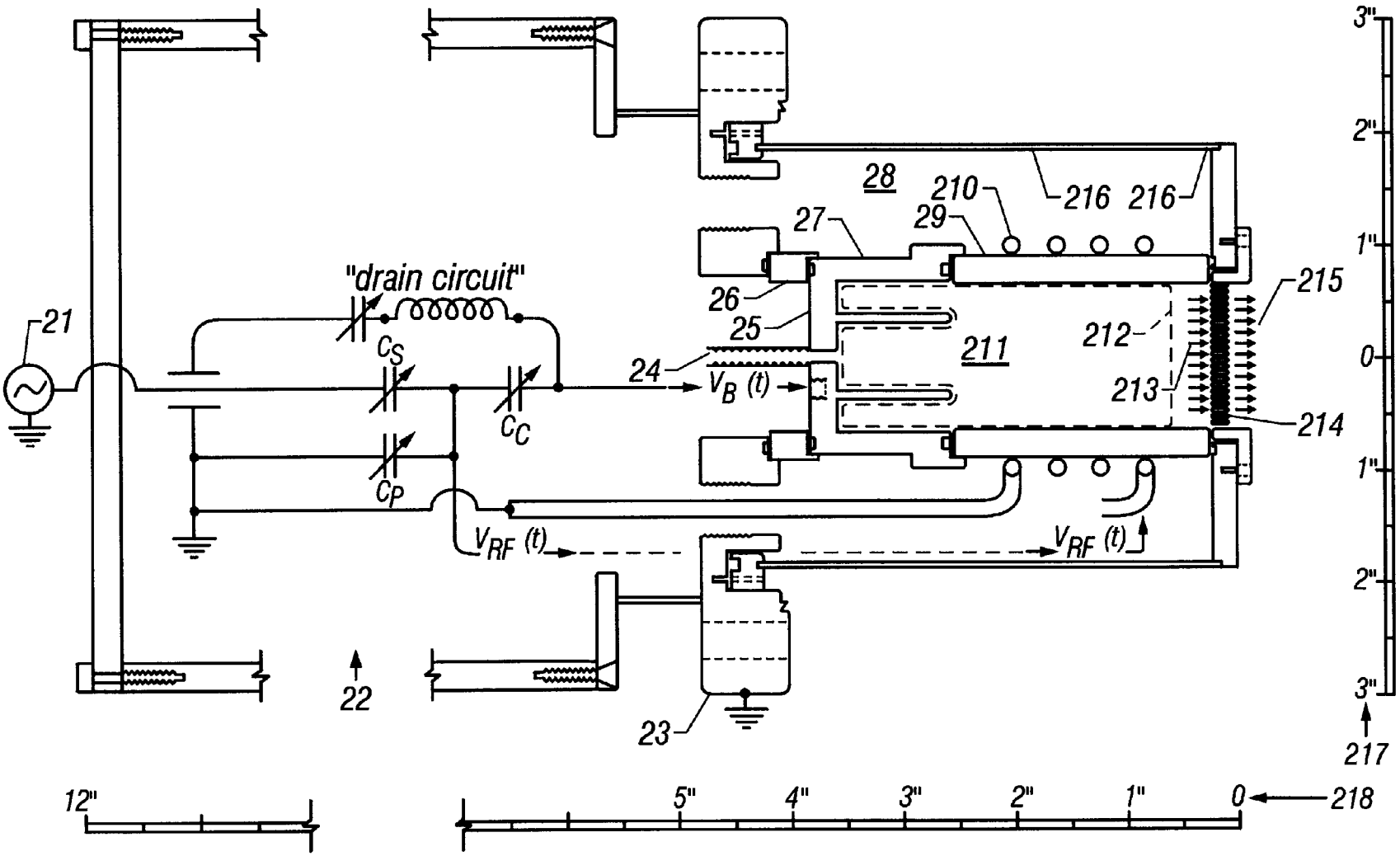
FIG. 2 is a representative schematic diagram showing the side view cross section of a small diameter (e.g., ~1") Directional Hyperthermal O-beam source.

Since the primary plasma is not designed for uniformity, the action of the RF accelerator as a homogenizer is important for the production of a uniform quiescent plasma and hence a uniform beam. This is true for a large diameter beam where a flat intensity profile is needed for wafer processing. A small diameter beam (e.g., ~1") for R&D purpose can get by with a Gaussian intensity profile. Therefore, the sequence of the primary plasma and the RF accelerator can be reversed. For example, FIG. 2 is a representative schematic diagram of a 1" Directional Hyperthermal O-beam Source with an RF generator 21. References 217 and 218 show the scale. The RF window is a dielectric tube as shown by 29. It can be a quartz or ceramic tube. The RF coil is a simple spiral coil as shown by 210. The RF accelerator, 27 is before the primary plasma region (where the dielectric tube, 29 is).

The source is shown mounted on a 6" CF flange (23), as an example. Gas (e.g., pure $O_2$) comes in through 24. Reference 25 is the air-side of the RF accelerator on which the $V_B(t)$ connection is made. Reference 26 is a dielectric (e.g., TEFLON) which allows the floating of the RF accelerator from RF-ground (23). Reference 26 should be sufficient in order to minimize the capacitance between the RF accelerator and the RF-ground (sometimes denoted $C_L$, the power-leak capacitance) in order to minimize power leak. The additional tube-shape structure inside the RF accelerator is simply representative to signify the importance of a sufficient $A_A$ for a healthy $V_B(t)$ offset. Reference 211 is the primary plasma. Plasma diffusion step, plasma homogenization, and quiescent plasma are not necessary here. Directly, reference 214 is the RF-grounded sub-Debye neutralizer grid. Reference 212 is the plasma sheath boundary. Again, the RF accelerator surface ($A_A$) relates to the plasma by the natural plasma potential $V_P(t)$ and the RF-grounded sub-Debye neturalizer surface ($A_G$) relates to the plasma by the artificial plasma potential $V_{PA}(t)$. Reference 216 is the Eddy Current Break which creates discontinuity of any RF induced current on the ground surface to eliminate power loss. Reference 28 is the cooling fluid (circulated through an external chiller); in this example, it is pure water. In this example, the RF accelerator (27) is made of stainless steel. Due to the pure water, the RF coil (210) needs to be properly prepared (e.g., as shown in FIG. 9). Reference 22 is representative of the impedance matching circuit. The cooling fluid is water; it is a water-submerged design. The high dielectric constant of water (κ~80) makes the use of the π configuration of $C_P$ and $C_S$ an efficient tuning circuit. Here, $C_P$ is the main Tank capacitor and $C_S$ trims the magnitude. With the proper RF dielectric constant trimmed RF coil design (e.g., as shown in FIG. 9), the water can supply 15% to 20% of the Tank capacitance (through the "$C_{PL}$", 842 of FIG. 8), in parallel to the $C_P$. This feature will be discussed later.

Reference 21 is the RF generator. For example, its frequency can be $\omega_1$=13.56 Mhz. $C_C$ is the main component to the RF accelerator circuit. It capacitively couples a controlled portion of the RF coil power to the RF accelerator; it determines the magnitude of the $V_B(t)$. Reference 213 is the accelerated plasma beam. Reference 215 is the Hyperthermal neutral beam. The "drain circuit" is for adjusting for a lower range of the beam energy ($E_K \sim V_{PA}(t) \sim V_B(t)$). For low energy range, set $C_C \rightarrow 0$ and tune the variable capacitor of the "drain circuit". The RF impedance of the drain circuit is $Z|\omega_1$. At this point $V_B$ goes down as $Z|\omega_1$ goes down towards zero (i.e., as the "drain" opens up). $V_B$ becomes minimum (close to zero) as $Z|\omega_1 \rightarrow 0$. And, we discovered that we should not tune the drain circuit towards $Z|\omega_1 \rightarrow 0$ when CC is set at high. High $C_C$ setting is for diverting a large portion of the RF coil power into the RF accelerator. If the drain circuit is fully open while a large amount of RF power is being diverted into the RF accelerator, the high drained RF current might burn the drain circuit. The drain circuit will be discussed in more detail in FIG. 8.

Figure 3:
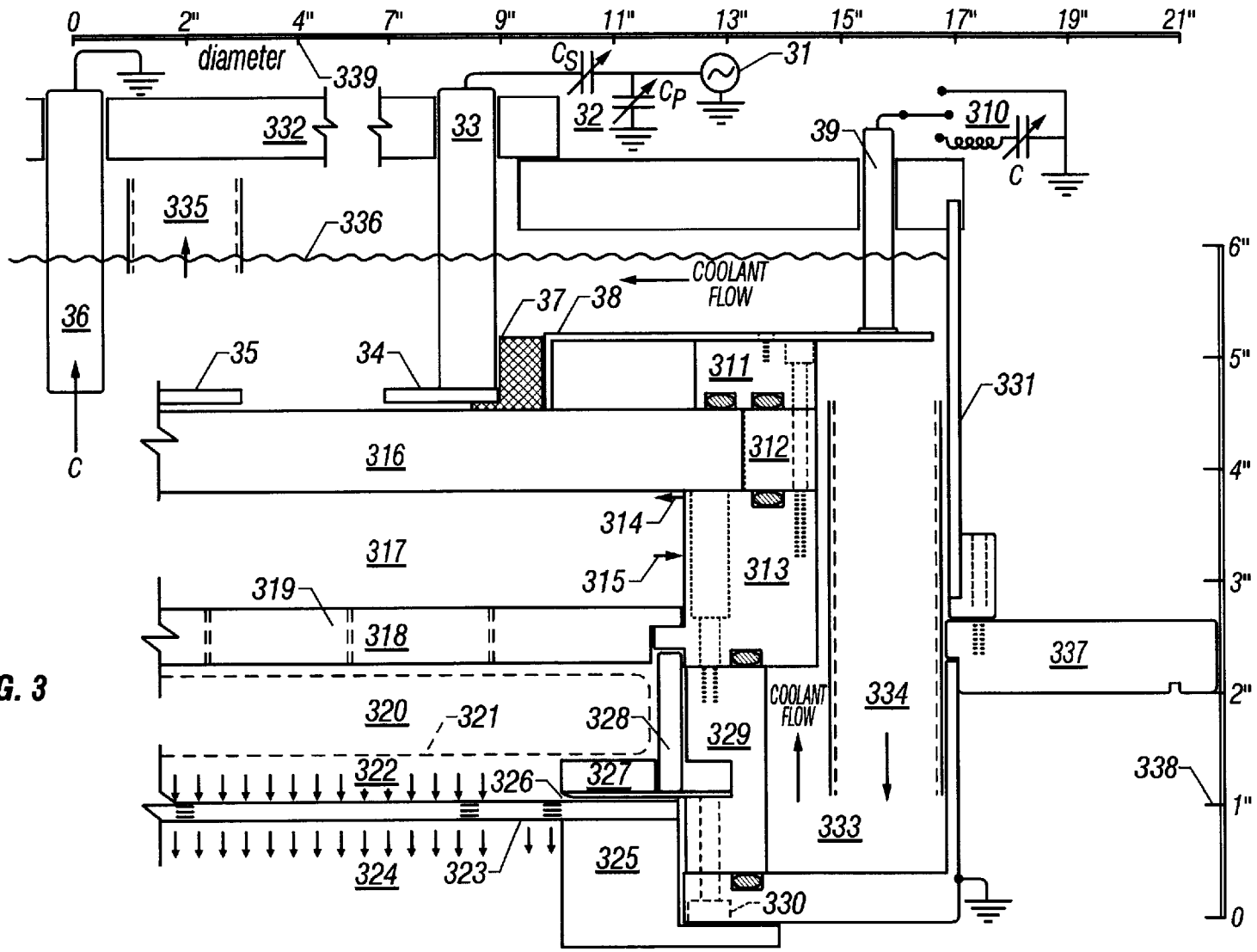
FIG. 3 is a schematic diagram showing the side view cross section of a 10" diameter Directional Hyperthermal O-beam Source.

FIG. 3 is the schematic diagram for the 10" Directional Hyperthermal O-beam Source. All components' functions are the same as that of FIG. 2 except for the roles and sequence of the RF accelerator and the primary plasma. Also, the cooling fluid for this example is purified mechanical pump oil which has κ~2. For such a low κ value, the $C_P$ and $C_S$ can be in the L arrangement since the $C_{PL}$ as illustrated by 742 of FIG. 7 can be very low.

References 338 and 339 are scale. Reference 31 is the RF generator (e.g., $\omega_1$=13.56 Mhz). Reference 32 is the L circuit. References 33 and 36 are the RF power connection rods to the RF coil. Since purified mechanical pump oil is the cooling fluid, bare copper rods or Ag coated Cu rods can be used (without any other surface protection). References 34 and 35 are the flat RF coil. Reference 34 is the outer turn and 35 is the inner turn. Reference 37 is a dielectric spacer (e.g., TEFLON). Reference 38 is the pick-up electrode (e.g., 24 pieces making up a full circle around the RF coil). References 37 and 38 together make the $C_C$, in this example. In another word, this preset "stray" $C_C$ is the $C_C$. Reference 311 is a stainless steel gas manifold which also serves as the clamp holding the RF window (316). Reference 312 is just an Al spacer with gas grooves shown. Reference 39 is a copper rod connecting reference 38 to a switch S (310). When switch 310 is connected to ground, the beam is abruptly turned off (dumping all the power to ground). The drain circuit of switch 310 is usually set at $Z|\omega_1 \rightarrow$maximum (minimum C) such that there is no power drain when the beam is switched to the on position. Reference 317 is the primary plasma. References 313 and 319 together form the RF accelerator (e.g., anodized Al). Reference 315 shows the Eddy Current Break. Reference 314 is the radial gas injection grooves (e.g., 24 of them just under the RF window). Primary plasma diffuses (while being homogenized) through the super-Debye accelerator openings (318) into the quiescent plasma region (320). Reference 321 is the plasma sheath boundary from which the plasma is accelerated by the $V_{PA}(t) \sim V_B(t)$. Reference 322 is the accelerated plasma beam. Reference 323 is the RF-grounded sub-Debye neutralizer grid. Reference 324 is the Hyperthermal neutral beam (e.g., O-beam). Reference 325 is the grid cooling heat sink manifold: a series of small tubes with a foot-print no more than ⅛" wide carrying the coolant (e.g., chilled alcohol) traverse the grid bottom to act as effective heat sink. Reference 329 is a dielectric spacer (e.g., DELRIN, TEFLON, ceramic) separating the RF accelerator from the neutralizer grid. Reference 330 is a series of brass bolts. Reference 326 is series of anodized Al support structures (unfortunately at ground) holding the quartz ring 327 and tube 328 to protect reference 329 and reference 326 from the plasma. Reference 333 is the plasma cooling fluid; in this example, it is oil. Reference 334 is a large tube supplying the cold coil. Reference 336 is the oil level. This example has open-channel flow system. Reference 335 is the suction return tube for the warm oil. Reference 331 is the dielectric coolant bucket (e.g., acrylic). Reference 332 is the dielectric lid (e.g., acrylic). Reference 337 is the source's mounting flange; this example uses an ISO 500 flange.

FIG. 4 shows the side view cross section of a section of the RF-grounded sub-Debye neutralizer grid, for the Directional Hyperthermal O-beam. For this example, Al can be used as the core of the grid. Its surface is just a layer of natural $Al_2O_3$ as a result of being in the pure $O_2$ plasma. An example of manufacturing the grid holes in the grid core is to use micro-machining using $Cl_2$-based conventional plasma RIE. Another example of manufacturing the grid holes is to use mechanical drilling. FIGS. 4(*a*) to (*d*) represent one RF period (e.g., ~70 ns for $\omega_1$~13.56 Mhz). Reference 43 is the plasma sheath boundary. The sheath thickness is $\delta \sim (eV_{PA})^{2/3} n_e^{-1/2} T_e^{-1/6}$. At the peak ion cycle (FIG. 4(d)), $\delta \geqq 2d$ qualifies the grid as a sub-Debye grid where d is the grid hole diameter. In this example, d is 0.005" and the hole length is 0.062" (high aspect ratio: 62/5) and the minimum wall thickness is 0.002". The top view of this grid core has a hexagonal close-pack configuration.

Reference 41 defines $A_G$. Reference 42 is the inner surface of the grid hole where neutralization takes place. In the peak electron cycle, the sheath is gone and electrons coat inner surface 42 (as well as $A_G$ 41). In the early ion cycle, sheath starts forming but collapsed. Now, ions are accelerated at large angle into inner space 42 (as shown by the arrows denoted as reference 45). On the average, in one collision, an ion is neutralized. A large angle injection is inelastic making the emerging neutrals low in energy as denoted by reference 48. As the sheath is straightened to "threshold" where $\delta \geqq 2d$ is satisfied, the injected ion interacts with inner surface 42 in a shallow angle in such a way that the resultant hyperthermal neutral can emerge out of the hole without any more collision (47). Therefore, the time of FIG. 4(*c*) and FIG. 4(*d*) constitute the "beam-on duty cycle". In another words, the hyperthermal neutrals formed in FIG. 4(*b*) are "washed out" by the high aspect ratio of the hole and there is essentially no hyperthermal neutral beam emerging out of the holes.

Figure 5:
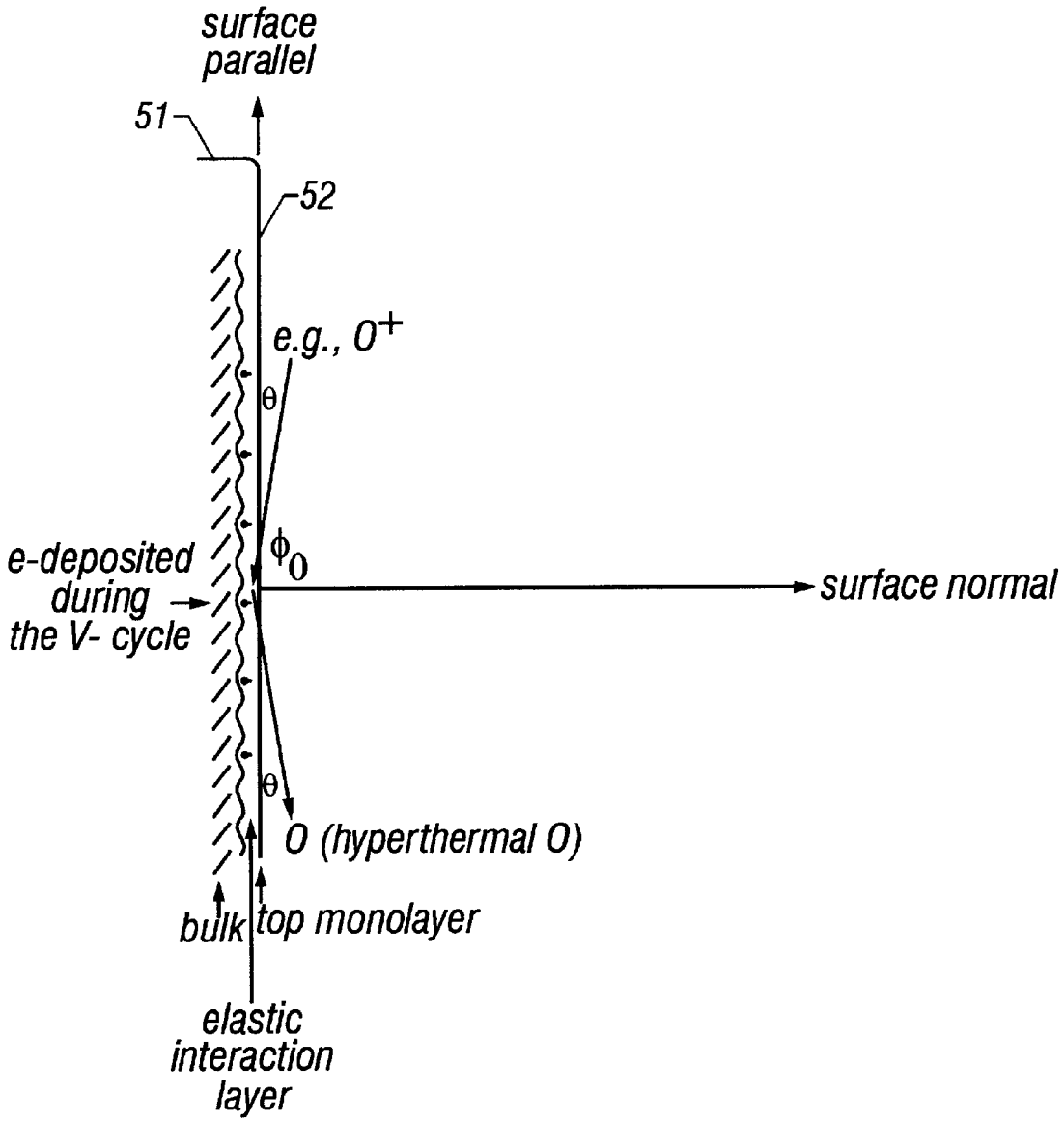
FIG. 5 is a representative drawing showing how surface neutralization by shallow angle elastic surface forward scattering works.

FIG. 5 depicts the neutralization mechanism by shallow angle elastic surface forward scattering. Reference 51 constitutes $A_G$ and 52 is the inner surface of the hole. The flux of the Hyperthermal O-beam is determined not only by the geometrical transparency of the RF-grounded sub-Debye neutralizer grid but also by the "beam-on duty cycle" condition. This is why the "sheath straightening" time is critical. The first-pass prototype 10" Directional Hyperthermal O-beam Source experimented with a neutralizer grid of 0.016" diameter and 0.130" long holes. Its Hyperthermal O flux can already peak at ~6 $mAcm^{-2}$ current equivalent. Experiments with smaller diameter holes such as 0.005" diameter and 0.060" long show that ~12 $mAcm^{-2}$ current equivalent is achievable. This is simply because that the threshold voltage $V_t$ (as shown in FIG. 4) occurs at a much lower value for the smaller diameter holes.

In FIG. 10, reference 101 is the threshold voltage $V_t$ for the neutralizer grid of 0.005" diameter×0.062" length holes, $\Delta t_2/T$ is the beam-on duty cycle, $\Delta t_1/T$ is the electron cycle and $\Delta t_3/T$ is the "waste cycle" when the hyperthermal neutral flux is not present and power is wasted into the neutralizer grid. For the Directional Hyperthermal O-beam anisotropic polymer etching, it is desirable not to bring the $V_{B+peak}$ higher than 200V. Above which, undesirable events can occur on the wafers. Therefore, for many reasons, it is critical to have small diameter holes for the RF-grounded sub-Debye neutralizer grid.

Figure 7:
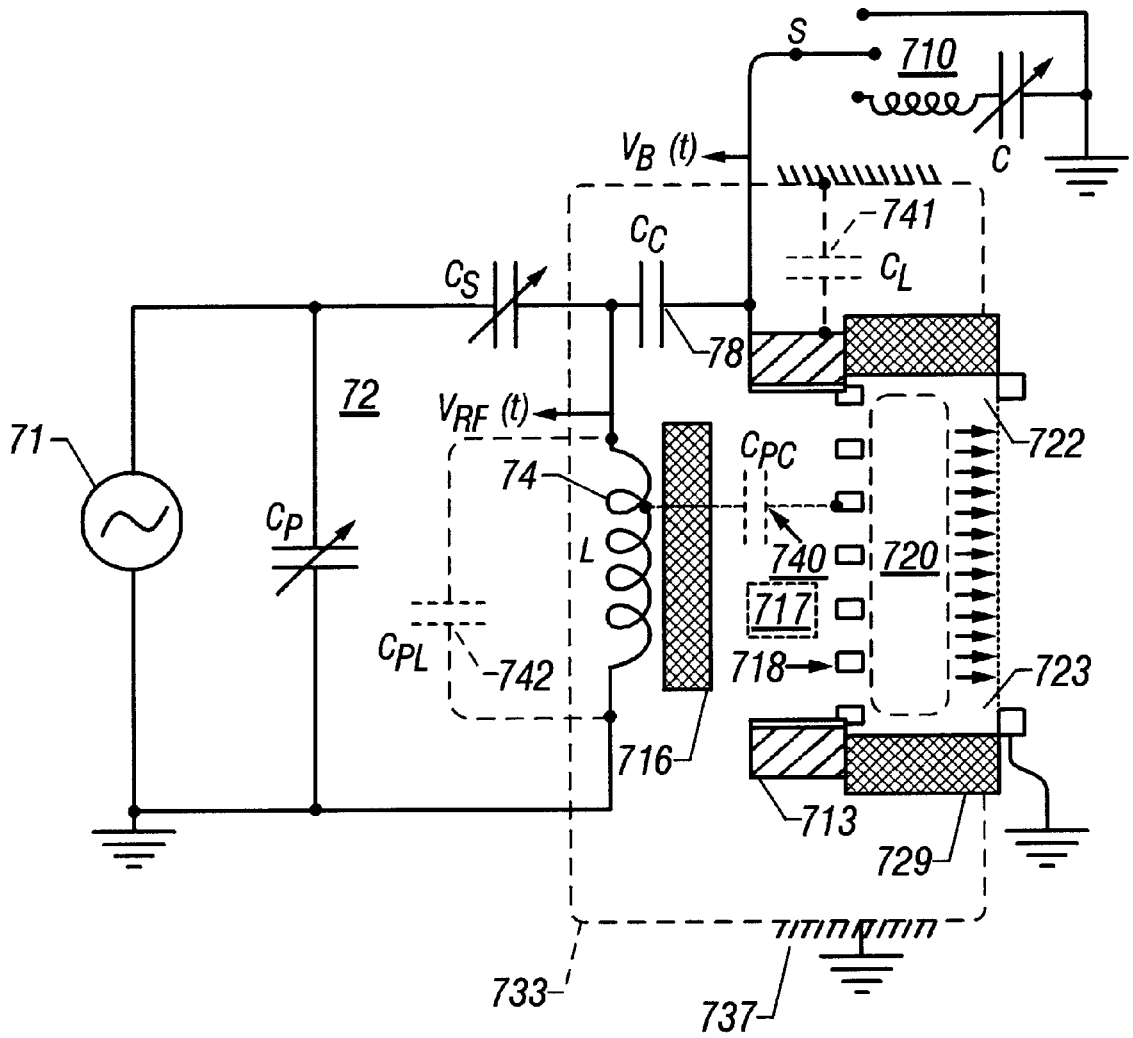
FIG. 7 is a circuit schematic for the 10" diameter Directional Hyperthermal O-beam Source.

FIG. 7 illustrates the 10" Directional Hyperthermal O-beam Source. Reference 71 is the RF generator (e.g., $\omega_1$=13.56 Mhz). Reference 723 is the neutralizer grid. Reference 729 is the dielectric spacer separating the neutralizer grid from the RF accelerator. Reference 729 would have to be sufficient in order to keep $C_L$ (741) low so that there is no power leak from the RF accelerator to ground (737). Reference 733 defines the boundary of the coolant (oil in this example which makes the requirement of a low $C_L$ easier to meet). Again, a L arrangement of $C_P$ and $C_S$ is shown (enabled by the oil coolant ambient). The use of oil coolant (κ~2) instead of water coolant (κ~80) makes $C_{PL}$ (742) small, enabling the use of the L type $C_P/C_S$ net work (72). If water is used as the coolant, a π type $C_P/C_S$ net work such as the one shown in FIG. 8 (844, 843) would have to be used. Reference 74 is the RF coil with an effective inductance denoted by L. Reference 716 is the RF window. Reference 717 is the primary plasma. References 718 and 713 together form the RF accelerator. Reference 720 is the quiescent plasma. There is some amount of stray capacitance coupling between the RF coil and the RF accelerator through the primary plasma, as denoted by $C_{PC}$ (740). This is generally not sufficient for the powering of the large size accelerator. Therefore, $C_C$ (78) is introduced as the main component in the capacitively coupled RF accelerator circuit. In this example, it is the preset combination of 37 and 38 of FIG. 3. When the switch S (710) is thrown to ground, the beam is turned off (dumping the power to ground). S being in any other positions enable the beam-on, as long as the $Z|\omega_1$ of the drain circuit is at its maximum (i.e., C of the drain circuit is turned to its minimum).

The arrows denoted by 722 represent the accelerated plasma beam. The acceleration voltage is the potential between the quiescent plasma (720) and the RF-grounded sub-Debye neutralizer grid (723) and this potential is the artificial plasma potential $V_{PA}(t)$. Consider one RF period, when $V_{PA}(t)$ reaches above the "threshold voltage" $V_t$ as shown by 101 of FIG. 10, the sheath is sufficiently straightened and the grid holes go sub-Debye (as shown by FIG. 4 (*c*)). At this point, the Hyperthermal neutrals start emerging out of the neutralizer grid. Therefore, $\Delta t_2/T$ of FIG. 10 is the beam-on duty cycle. Again, the shape of $V_B(t)$ of FIG. 10 is mainly determined by the area ratio between the RF accelerator ($A_A$) and the RF-grounded sub-Debye neutralizer grid ($A_G$), as described earlier. $A_A$ encompasses essentially the entire primary plasma metal boundary (i.e., 713 and 718 of FIG. 7, the RF accelerator) which relates to the plasma by the natural plasma potential $V_P(t)$. $A_G$ is essentially the top surface area of the RF-grounded sub-Debye neutralizer grid which relates to the plasma by the artificial plasma potential $V_{PA}(t)$. Since the beam is considered on only during the beam-on duty cycle when the grid holes have gone sub-Debye, $A_G$ is actually the metal area denoted by 41 of FIG. 4 plus the open area (all the holes' area). In other words, $A_G$ is the area of the plasma sheath boundary denoted by 43 of FIG. 4(*c*) and FIG. 4(*d*).

Figure 8:
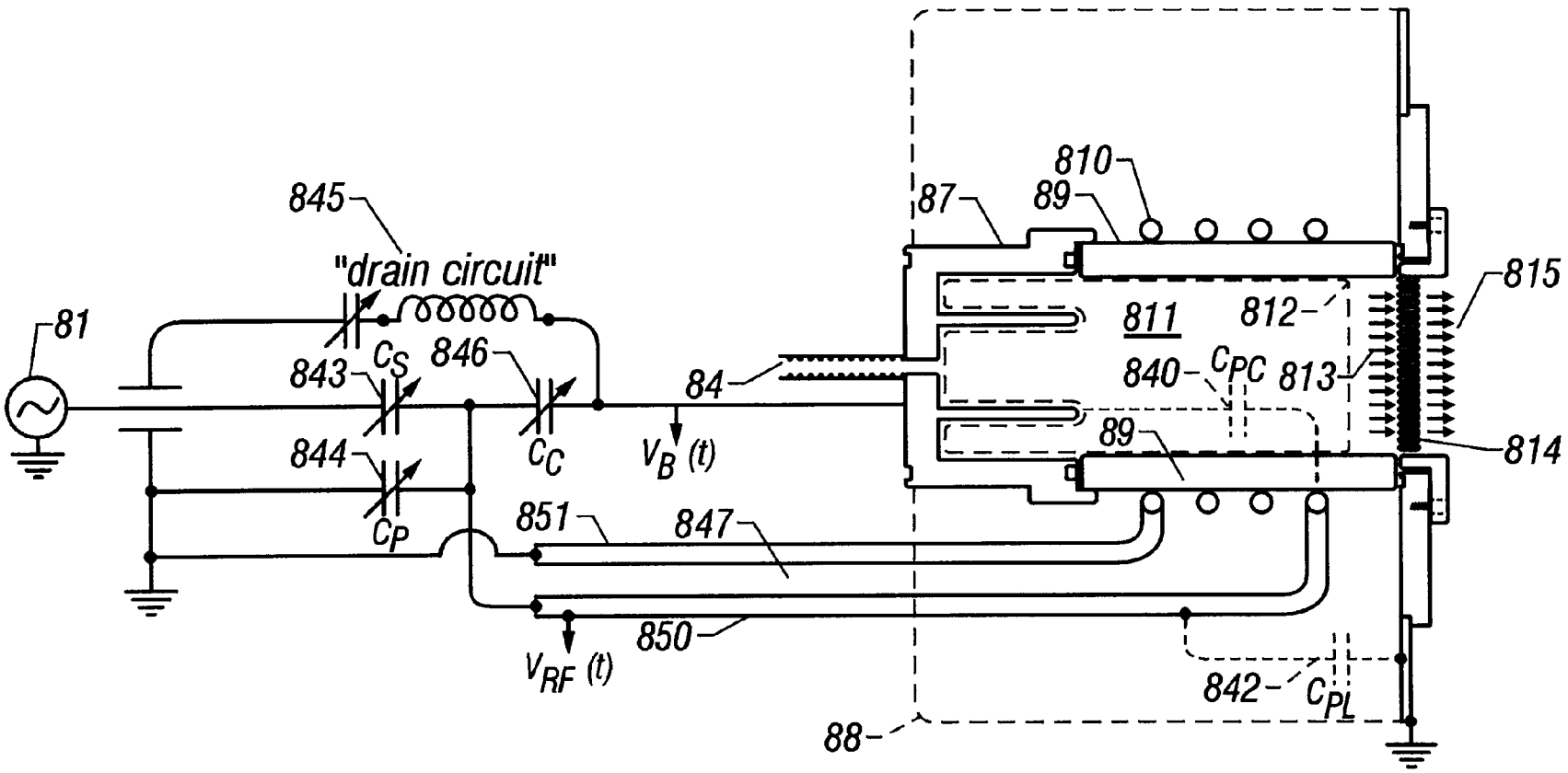
FIG. 8 is a circuit schematic for the 1" diameter Directional Hyperthermal O-beam Source.
Figure 9:
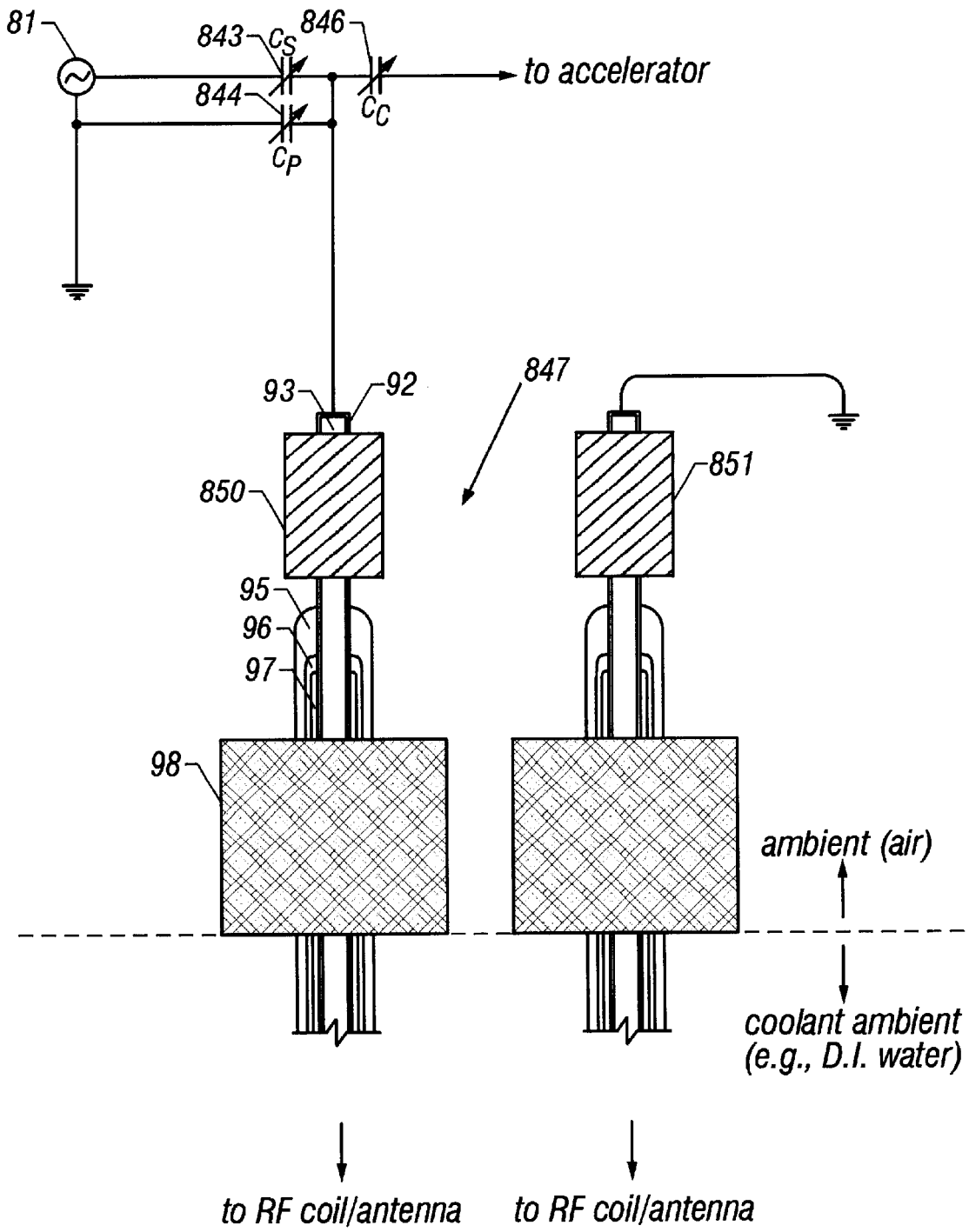
FIG. 9 is a representative drawing showing the method of RF dielectric constant trimming for the RF coil in a liquid-submerged plasma.

FIG. 8 is a representative circuit schematics for the 1" Directional Hyperthermal O-beam Source with the RF generator 81. Reference 88 defines the liquid coolant boundary. In this example, it is pure water. Therefore, the π arrangement of the $C_P/C_S$ (843, 844) net work is used. $C_P$ is the main Tank capacitor. Reference 810 is the RF coil surrounding the dielectric tube (quartz or ceramic) RF window (89). The stray, $C_{PL}$ (842) is actually a minor parallel Tank capacitor. It can supply 15% to 20% of the Tank current, with the properly designed RF coil (as illustrated in FIG. 9). For the small diameter source, $C_{PC}$ (840) is generally sufficient to power the RF accelerator (87), even when $C_C$ (846) is turned to its minimum. Further increase of $C_C$ from its minimum (while drain circuit (845) $Z|\omega_1$=maximum), simply increases the amount of RF coil power tapped into the RF accelerator. To further decrease the amount of the RF power into the RF accelerator from the minimum $C_C$ position, one simply starts opening the drain circuit towards $Z|\omega_1$~0. Reference 811 is the plasma. Reference 812 is the plasma sheath boundary. Reference 813 represents the accelerated plasma beam. Reference 814 is the RF-grounded sub-Debye neutralizer grid. Reference 815 represents the Hyperthermal O-beam. Since $C_{PL}$ simply acts as a minor (~15%) parallel Tank capacitor for a properly designed RF coil (as illustrated in FIG. 9), the main effect of the adjacency (847) of the RF coil feed lines, 850 and 851, is inductance cancellation of the feed lines. A majority of the Tank circuit inductance concentrates in the RF coil (810) surrounding the RF window (89).

FIG. 9 illustrates the RF coil feed lines at the interface of air ambient and coolant ambient, for the cases of high κ coolant (e.g., pure water). Reference 98 is the water-tight feed through (usually TEFLON). Reference 93 is the conductor rod, usually copper. For high current operation, the Cu rod can be coated with Ag (92). The entire RF coil below the feed throughs are continuously covered with the covers, 95, 96, 97 so that the conductor surface is not at all exposed to the cooling water. In general, the RF coil cover can be a single layer of low κ dielectric (e.g., water-tight, tightly wrapped TEFLON, κ~2). The resultant dielectric constant in this system of RF coil conductor, "continuous" tight TEFLON wrap and water, will be very close to that of the TEFLON. It is important that the low κ coil cover must be "continuous" in order for this method to work. For simple and low cost experimental purposes, this method is demonstrated with the 95, 96, 97 composite wrap. Reference 97 is a "white" electrical shrink-wrap. Reference 96 is a continuous spiral wrap of TEFLON tape. Reference 96 is then tightly secured with a "clear" electrical shrink wrap. The resultant dielectric constant and behavior is very close to that of TEFLON and the high κ nature of water is successfully masked.

Figure 11:
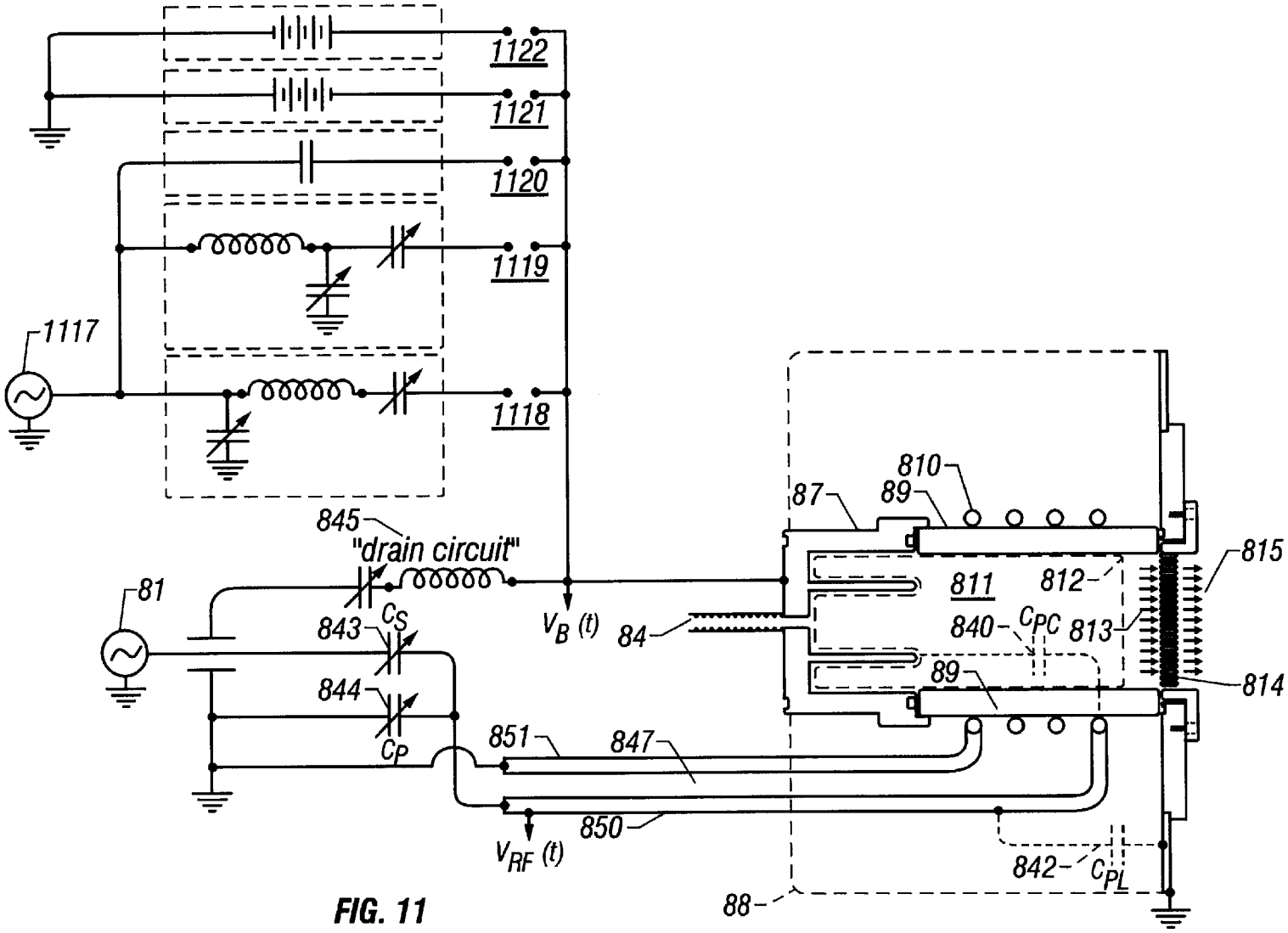
FIG. 11 is a circuit schematic showing the external bias method.
Figure 13:
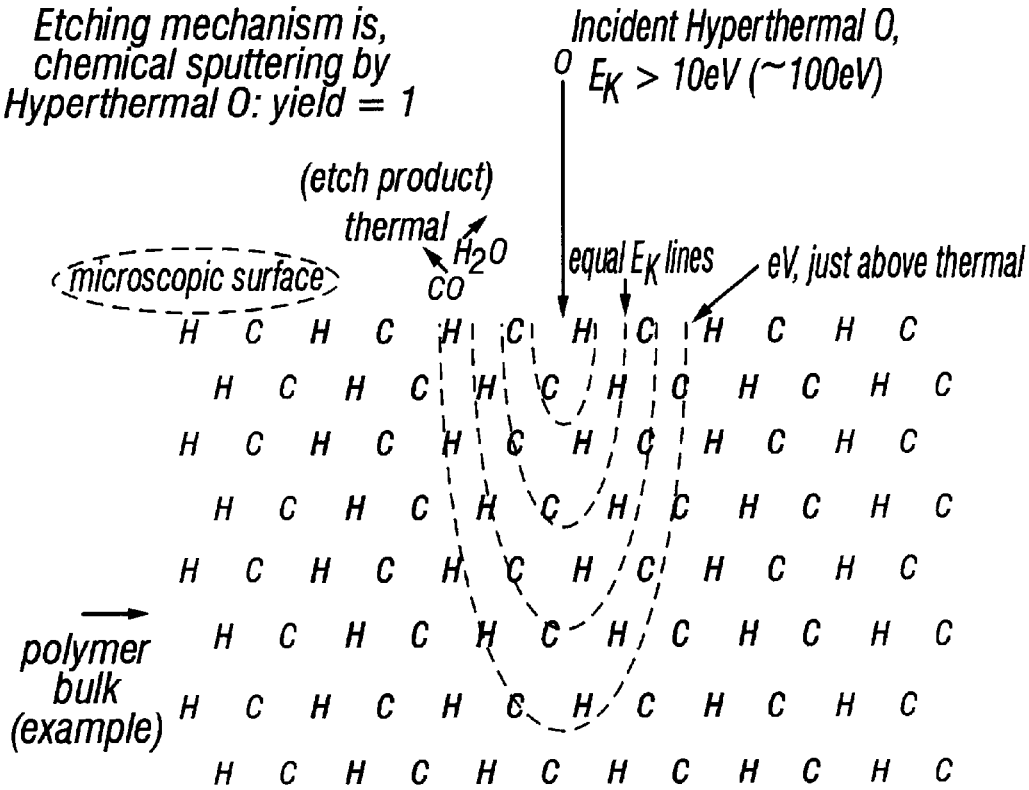
FIG. 13 is a representative diagram showing the side view cross section of the polymer top surface (a microscopically rough surface) and its interaction with a normal incident Hyperthermal O-beam.
Figure 14:
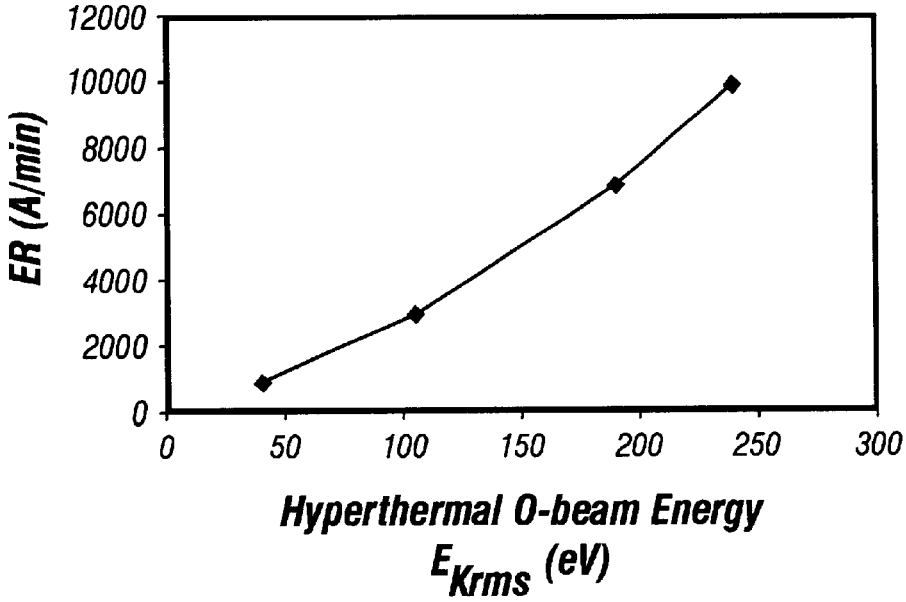
FIG. 14 shows an example of the performance of Hyperthermal O-beam polymer etching, by using a small diameter (e.g., ~1") Directional Hyperthermal O-beam Source. The data shows a polymer etch rate as a function of the Hyperthermal O energy. In fact, this data actually reflects the polymer etch rate as a function of the Hyperthermal O flux. This is because from the fundamental Hyperthermal O-beam polymer etching mechanism, it is known that the polymer etch efficiency reaches and stays at unity when the incident O energy is above ~10 eV.

FIG. 11 illustrates the external bias conditions and is similar to the O beam source illustrated in FIG. 8. Reference 81 is the main RF generator (e.g., $\omega_1$=13.56 Mhz) and Reference 1117 is the external-bias RF generator at $\omega_2$ (e.g., 1 or 2 Mhz) such that $\omega_2$ is clearly outside of the Q curve of the $\omega_1$ discharge circuit. For example, $\omega_2$ would have to be in the khz range or back at 13.56 Mhz range if $\omega_1$=2 Mhz is used. For external bias, $C_C$ can simply be removed. The only $\omega_1$ coupling to the RF accelerator is through stray ($C_{PC}$, 1140). Next, the drain circuit (1145) has to be fully open (drain circuit $Z|\omega_1$=0). At this point, the peak of $V_B(t)$ will be very close to 0. Next, either circuits 1118, 1119, 1120, 1121 or 1122 can be connected to the "accelerator". Circuit 1118 is for efficient power coupling when plasma impedance ($R_P$) is greater than 50Ω; circuit 1119 is for $R_P$<50Ω. Circuit 1120 is when an efficient power coupling is not required and $R_P$ can be in any value range. Circuit 1121 is for the extraction of a DC negative ion (or electron) beam and circuit 1122 is for the extraction of a DC positive ion beam. Naturally, for an efficient extraction of any charged beam, the grid (814) would have to be of a very low aspect ratio type.

For resist stripping and organic contaminant cleaning where a Directional Hyperthermal O-beam (FIG. 5, θ~3° to 6°) is not required. A Divergent Hyperthermal O-beam would do. As long as the divergent angle is not too great (θ≦25°), the hyperthermal O will have sufficient energy to make to the bottom of deep features on a wafer, to do its work. FIG. 12 is the counterpart of FIG. 4 for a Divergent Hyperthermal O-beam. FIG. 12 shows the one RF period operation of the RF-grounded border-line sub/super-Debye neutralizer grid, for a Divergent Hyperthermal O-beam. Reference 41 is the top surface of the wall separating two adjacent holes. Reference 42 is the inner surface of the hole where the surface neutralization takes place. Reference 48 represents the effusion of the thermalized species from the plasma. For this example, the hole diameter is 0.025", length is 0.040" and the thinnest wall is 0.007". The top view of the grid is also hexagonal close-pack. $V_t$ for a 0.025" diameter hole will be very high under normal plasma condition. Therefore, if the peak of the $V_B(t)$ is controlled to sufficiently low (e.g., ~50V), the grid will never go sub-Debye FIG. 12(*b*), 12(*c*), 12(*d*). Reference 43 is the plasma sheath a boundary. Reference 46 represents the accelerated plasma beam. Reference 47 represents the Hyperthermal O-beam. As long as θ can be sufficiently small (e.g., θ≦25°), 46 can be neutralized on the inner surface (42) into 47 without losing much energy to the grid FIG. 12(*b*), 12(*c*), 12(*d*).

The present invention discloses an RF-grounded sub-Debye neutralizer grid that is suitable for use in a plasma reactor and with an Oxygen plasma beam. The grid comprises an aluminum grid core that is RF-grounded. The grid core comprises a plurality of grid holes. Each individual grid hole of the plurality of grid holes further comprises a sub-Debye hole where the diameter of said sub-Debye hole is smaller than the sheath thickness of the plasma and where the sub-Debye hole has a high aspect ratio. Additionally, an inner surface of each individual grid hole of the plurality of grid holes forms a natural ceramic of $Al_2O_3$ in the presence of the plasma where the inner surface produces a surface neutralization by shallow angle elastic surface forward scattering.

Other embodiments of the invention will be apparent to those skilled in the art after considering this specification or practicing the disclosed invention. The specification and examples above are exemplary only, with the true scope of the invention being indicated by the following claims.

We claim the following invention:

1. An RF-grounded sub-Debye neutralizer grid that is suitable for use in a plasma reactor and with a plasma beam, comprising:

a grid core that is RF-grounded;

a plurality of grid holes, said grid holes are within said grid core;

each grid individual hole of said plurality of grid holes further comprises a sub-Debye hole wherein the diameter of said sub-Debye hole is smaller than the sheath thickness of the plasma and wherein said sub-Debye hole has a high aspect ratio; and an inner surface of said each individual grid hole of said plurality of grid holes that forms a natural ceramic in the presence of the plasma, said inner surface produces a surface neutralization by shallow angle elastic surface forward scattering.

2. The grid of claim 1 wherein said grid core comprises aluminum.

3. The grid of claim 1 wherein said natural ceramic comprises $Al_2O_3$.

4. The grid of claim 1 wherein the plasma comprises an oxygen plasma.

5. A system that uses an RF-grounded sub-Debye neutralizer grid that is suitable for use in a plasma reactor and with a plasma beam, comprising:

a grid core that is RF-grounded;

a plurality of grid holes, said grid holes are within said grid core;

each individual grid hole of said plurality of grid holes further comprises a sub-Debye hole wherein the diameter of said sub-Debye hole is smaller than the sheath thickness of the plasma and wherein said sub-Debye hole has a high aspect ratio; and an inner surface of said each individual grid hole of said plurality of grid holes that forms a natural ceramic in the presence of the plasma, said inner surface produces a surface neutralization by shallow angle elastic surface forward scattering.

6. The system of claim 5 wherein said grid core comprises aluminum.

7. The system of claim 5 wherein said natural ceramic comprises $Al_2O_3$.

8. The system of claim 5 wherein the plasma comprises an oxygen plasma.

9. A method to manufacture an RF-grounded sub-Debye neutralizer grid that is suitable for use in a plasma reactor and with a plasma beam, comprising:

providing a grid core;

RF-grounding said grid core;

providing said grid core with a plurality of grid holes wherein each individual grid hole of said plurality of grid holes further comprises a sub-Debye hole wherein the diameter of said sub-Debye hole is smaller than the sheath thickness of the plasma and wherein said sub-Debye hole has a high aspect ratio; and providing an inner surface to said each individual grid hole of said plurality of grid holes that forms a natural ceramic in the presence of the plasma, said inner surface produces a surface neutralization by shallow angle elastic surface forward scattering.

10. The method of claim 9 wherein said grid core comprises aluminum.

11. The method of claim 9 wherein said natural ceramic comprises $Al_2O_3$.

12. The method of claim 9 wherein the plasma comprises an oxygen plasma.

13. A method to use an RF-grounded sub-Debye neutralizer grid that is suitable for use in a plasma reactor and with a plasma beam, comprising:

providing a plasma above a grid core that is RF-grounded; and beaming said plasma through a plurality of grid holes within said grid core, wherein each individual grid hole of said plurality of grid holes further comprises a sub-Debye hole wherein the diameter of said sub-Debye hole is smaller than the sheath thickness of the plasma and wherein said sub-Debye hole has a high aspect ratio, said each individual grid hole of said plurality of grid holes further comprises an inner surface that forms a natural ceramic in the presence of said plasma, said inner surface produces a surface neutralization by shallow angle elastic surface forward scattering.

14. The method of claim 13 wherein said grid core comprises aluminum.

15. The method of claim 13 wherein said natural ceramic comprises $Al_2O_3$.

16. The method of claim 13 wherein said plasma comprises an oxygen plasma.

* * * * *